US009878867B2

(12) United States Patent
Yamamiya

(10) Patent No.: US 9,878,867 B2
(45) Date of Patent: Jan. 30, 2018

(54) CARD FEEDING APPARATUS

(71) Applicant: Asahi Seiko Co., Ltd., Tokyo (JP)

(72) Inventor: Takahito Yamamiya, Saitama (JP)

(73) Assignee: ASAHI SEIKO CO., LTD. (JP)

( * ) Notice: Subject to any disclaimer, the term of this patent is extended or adjusted under 35 U.S.C. 154(b) by 0 days.

(21) Appl. No.: 15/219,871

(22) Filed: Jul. 26, 2016

(65) Prior Publication Data

US 2017/0029232 A1 Feb. 2, 2017

(30) Foreign Application Priority Data

Jul. 29, 2015 (JP) ..... 2015-149088
Mar. 30, 2016 (JP) ..... 2016-068005

(51) Int. Cl.
*B65H 5/22* (2006.01)
*B65H 31/24* (2006.01)
(Continued)

(52) U.S. Cl.
CPC ..... *B65H 31/24* (2013.01); *B65H 1/06* (2013.01); *B65H 3/02* (2013.01); *B65H 5/04* (2013.01);
(Continued)

(58) Field of Classification Search
CPC ..... B65H 2408/113; B65H 31/24; B65H 2405/332; B65H 2405/353
See application file for complete search history.

(56) References Cited

U.S. PATENT DOCUMENTS 3,687,540 A 8/1972 Hashimoto
4,816,864 A * 3/1989 Tanaka ..... G03G 15/50 399/81
(Continued)

FOREIGN PATENT DOCUMENTS

CN 104016151 3/2014
JP H0433187 2/1992
(Continued)

OTHER PUBLICATIONS

Extended European Search Report dated Jan. 5, 2017 for Corresponding European Patent Application No. 16181362.1 (7 pages).
(Continued)

*Primary Examiner* — Howard Sanders

(57) ABSTRACT

A card feeding apparatus realizes random and selective feeding of cards of different types or kinds. This apparatus includes a card supplying device, a card holding and feeding device, and a controller. The card holding and feeding device includes a table set having tables on which cards from the card supplying device are held, a table set supporting structure (e.g., a frame), a table set moving device (e.g., a lifting mechanism), and a card conveying device that conveys cards held on the tables. In response to a card feeding signal, the table set supporting structure is temporarily stopped using the table set moving device such that a target table designated from the tables by the said signal is located at the card conveying position, and the card holding and feeding device is activated, thereby feeding a card on the target table by the card conveying device.

12 Claims, 27 Drawing Sheets

(51) Int. Cl.

| | |
|---|---|
| ***B65H 3/02*** | (2006.01) |
| ***B65H 5/04*** | (2006.01) |
| ***B65H 5/06*** | (2006.01) |
| ***B65H 5/26*** | (2006.01) |
| ***B65H 7/02*** | (2006.01) |
| ***B65H 1/06*** | (2006.01) |
| ***B65H 7/20*** | (2006.01) |
| ***B65H 29/12*** | (2006.01) |
| ***B65H 43/02*** | (2006.01) |

(52) U.S. Cl.
CPC ..... *B65H 5/062* (2013.01); *B65H 5/064* (2013.01); *B65H 5/26* (2013.01); *B65H 7/02* (2013.01); *B65H 7/20* (2013.01); *B65H 29/12* (2013.01); *B65H 43/02* (2013.01); *B65H 2405/332* (2013.01); *B65H 2405/353* (2013.01); *B65H 2408/113* (2013.01); *B65H 2701/1914* (2013.01)

(56) References Cited

U.S. PATENT DOCUMENTS 5,374,043 A * 12/1994 Mandel ..... B42C 1/125 270/58.14
2009/0001095 A1* 1/2009 Yamamiya ..... B65H 1/06 221/268

FOREIGN PATENT DOCUMENTS

| | | |
|---|---|---|
| JP | 05-210783 | 8/1993 |
| JP | 2008-254923 | 10/2008 |
| JP | 4991995 | 8/2012 |

OTHER PUBLICATIONS

First Office Action dated Jul. 20, 2017 for Corresponding Chinese Patent Application No. 201610608787.9 with English language translation (15 pages).
Office Action dated Oct. 12, 2017 for Corresponding Japanese Patent Application No. 2016-068005 with English language translation (7 pages).

* cited by examiner

CARD FEEDING APPARATUS

BACKGROUND OF THE INVENTION

1. Field of the Invention

The present invention relates to a card feeding apparatus and more particularly, to a card feeding apparatus having a function of supplying cards on respective tables from a card stack and feeding the cards placed on the respective tables toward the outside one by one.

The present invention is preferably applied to random and selective feeding of cards of different types or kinds.

The term "card" used in this specification means widely card-shaped articles, which includes not only typical cards such as telephone cards, prepaid cards, character cards, portrait photographs, IC (Integrated Circuit) cards, magnetic-stripe cards (e.g., credit cards and bank cards), and bar-coded cards, but also other thin plate-shaped articles made of paper, plastic or the like that are equivalent to or larger than the typical cards in thickness.

2. Description of the Related Art

Conventionally, as the first prior art of the present invention, a card feeding apparatus for separating the lowest-positioned card from a card stack in which a plurality of cards are stacked vertically in a line one by one and for feeding the card thus separated in a predetermined feeding direction is known, which is disclosed in the Japanese Patent No. 4991995 issued on Aug. 8, 2012. This prior-art apparatus comprises a card storing means for storing a plurality of cards in a card stack in such a way as to be stacked vertically in a line, and a card feeding means for separating the lowest-positioned card from the card stack and for feeding the card thus separated in a predetermined feeding direction.

In the card stack of the card storing means, the opposing faces of the two adjoining cards are in contact with each other, and all the stacked cards are arranged so as to form a quadrangular prism.

The card feeding means comprises a base to which a card is pressed during conveyance, a conveying member on which a card separated from the card stack in the card storing means is placed in such a way that the card is sandwiched by the base and the conveying member, and a flat loop moving means for moving the conveying member in such a way as to draw a flat loop. By the motion of the flat loop moving means, the card held by the base and the conveying member is fed in the feeding direction utilizing friction force among them (see FIGS. 1, 4, and 5 and Paragraphs 0040 to 0049).

As the second prior art of the present invention, an automatic card issuing apparatus is known, which is disclosed in the Japanese Non-Examined Patent Publication No. 5-210783 issued on Aug. 20, 1993. This prior-art apparatus comprises a card stacker for storing a plurality of cards in the form of stack without mutual touch among the cards, a pushing member for pushing a desired card selected from the stacked cards in the card stack out of the card stack, and a card detector for detecting the presence and absence of the respective cards in the card stack. The card stacker and/or the card pushing member is/are moved upward and downward.

While moving the card stacker and/or the card pushing member upward and downward motion, the card detector detects whether or not a card is held at a specified one from the card positions in the card stack. If no card is found at the specified card position, the card detector detects whether or not a card is held at a next card position again. This card detection process is repeated until a card is found at the specified card position. On the other hand, if a card is found at the specified card position, the pushing member is moved to the specified card position and pushes the card held at the same position to the outside of the card stacker (see FIGS. 1 to 3 and Paragraphs 0015 to 0023).

In recent years, the use of the card feeding apparatus of this type has been diversifying. For example, one use of this apparatus is to feed randomly a plurality of cards of different types or kinds according to the necessity in the single card feeding apparatus.

In the case where the aforementioned first prior-art card feeding apparatus is used for this purpose, a plurality of cards of different types/kinds is stacked vertically in a predetermined order to form a card stack in the card storing means. If so, the types/kinds of the cards to be fed are determined in accordance with the predetermined stacking order of the cards, which means that the cards of different types/kinds are unable to be fed randomly according to the necessity. If the first prior-art card feeding apparatus disclosed in the Japanese Patent No. 4991995 is provided for each type/kind of the cards, the cards of different types/kinds are able to be fed in a random order by selectively activating one of the first prior-art card feeding apparatuses according to the necessity. In this case, however, there arises a problem that the overall size of the combination of the first prior-art card feeding apparatuses is excessively enlarged and the fabrication cost is also raised.

On the other hand, in the case where the aforementioned second prior-art card issuing apparatus disclosed in the Japanese Non-Examined Patent Publication No. 5-210783 is used for this purpose, the card pushing operation by the pushing member is able to be performed only at the card position where the presence of a card is detected by the card detector. This means that there arises a problem that the total number of cards to be fed is limited. If the total number of cards that can be stored in the card stacker is increased, this problem can be solved; however, there arises another problem that the card stacker is excessively upsized.

SUMMARY OF THE INVENTION

The present invention was created to solve the above-mentioned problems, and an object of the present invention is to provide a card feeding apparatus that ensures random and selective feeding of cards in a predetermined direction even if the cards are of different types or kinds.

Another object of the present invention is to provide a card feeding apparatus that ensures random and selective feeding of cards of different types or kinds in a predetermined direction while restraining excessive increase of the overall size of the apparatus and ensuring a desired total number of cards to be fed.

The above objects together with others not specifically mentioned will become clear to those skilled in the art from the following description.

To accomplish the aforementioned objects, a card feeding apparatus according to the present invention comprises:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure (e.g., a frame) that supports the table set so as to enclose all the tables;

a table set moving device (e.g., a lifting mechanism) that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction.

With the card feeding apparatus according to the present invention, the card supplying device and the card holding and feeding device each having the aforementioned structures and functions are provided, and the operation of the card supplying device and the operation of the card holding and feeding device are controlled by the controller.

Under control of the controller, the table set supporting structure is temporarily stopped at the predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set.

Therefore, if cards of different types/kinds are stored so as to form a card stack in the card storing section of the card supplying device in advance, the cards of the different types/kinds can be placed and held on the respective tables of the table set.

Furthermore, under control of the controller, in response to the card feeding signal sent from the upper-level device of the apparatus, the table set supporting structure is temporarily stopped in such a way that the target table which is designated by the card feeding signal from the tables of the table set is located at the card conveying position, and the card conveying device is activated, thereby conveying the card held on the target table toward the outside of the apparatus in the card feeding direction.

Therefore, even if cards of different types/kinds have been placed and held on the respective tables of the table set, the desired cards can be selectively and randomly fed in the card feeding direction toward the outside of the apparatus according to the necessity.

Accordingly, random and selective feeding of cards in a predetermined direction can be ensured even if the cards are of different types or kinds.

In addition, unlike the aforementioned first prior-art card feeding apparatus disclosed in the Japanese Patent No. 4991995, a plurality of card supplying devices and a plurality of card holding and feeding devices need not be provided for each type/kind of cards. Thus, the overall size of the card feeding apparatus according to the present invention is not excessively enlarged.

Further in addition, unlike the aforementioned second prior-art card issuing apparatus disclosed in the Japanese Non-Examined Patent Publication No. 5-210783, the cards which have been held on the respective tables of the table set can be selectively and randomly fed one by one in the card feeding direction in response to the card feeding signal. Thus, by determining appropriately the size of the card storing section of the card supplying device, the limitation on the total number of the cards to be fed can be eliminated.

Accordingly, random and selective feeding of the cards of different types or kinds in a predetermined direction can be ensured while restraining excessive increase of the overall size of the apparatus and ensuring a desired total number of the cards to be fed.

In a preferred embodiment of the card feeding apparatus according to the present invention, in response to the card feeding signal, a placing motion of an additional card which is supplied from the card supplying device on the target table is interlocked with a conveying motion of the card held on the target table.

In this embodiment, since the placing motion of the additional card on the target table from the card supplying device can be performed immediately after the conveying motion of the card held on the target table, there is an additional advantage that the card feeding apparatus operates more efficiently or at a higher speed.

In another preferred embodiment of the card feeding apparatus according to the present invention, there is further provided with a sliding mechanism for selectively sliding a specified one of the tables of the table set to the card conveying position so as to be interlocked with a vertical motion of the table set without sliding the remaining tables.

In this embodiment, since an interval can be provided between the card supplying device and the table set, there is an additional advantage that interference between the card supplying device and the table set can be surely avoided.

In this embodiment, it is preferred that a pair of sidewalls arranged respectively at both sides of the table set with respect to the card feeding direction are further provided, wherein each of the pair of sidewalls comprises a cam hole having a first linear part, a second linear part, and a bended part formed between the first and second linear parts. Each of the tables in the table set has right and left cam followers which are respectively engaged with the cam holes of the pair of sidewalls. The com holes of the pair of sidewalls and the cam followers of the tables constitute the sliding mechanism.

In this case, since there is no need to provide a new driving mechanism for selectively sliding the specified table, there is an additional advantage that the fabrication cost of the card feeding apparatus can be prevented from increasing.

In a further preferred embodiment of the card feeding apparatus according to the present invention, the card conveying device comprises a pair of rollers which is contactable with a card held on the target table. When feeding the card held on the target table, the pair of rotating rollers is contacted with the card on the target table at its two side edges, thereby conveying the card on the target table in the card feeding direction. The cards held on all the tables in the table set are kept detached from the pair of rotating rollers while the table set is moved vertically.

In this embodiment, there is an additional advantage that the card held on the target table can be conveyed more surely and that the danger of hindering the vertical motion of the table set can be eliminated.

In a still further preferred embodiment of the card feeding apparatus according to the present invention, each of the tables in the table set comprises a lever which is moved between a standby position and a protruded position in response to a placing motion of a card, wherein presence and absence of a card on each of the tables is judged by detecting which one of the standby position and the protruded position the lever is located at.

In this embodiment, there is an additional advantage that the presence and absence of a card on each of the tables can be found with a comparative simple structure.

In a still further preferred embodiment of the card feeding apparatus according to the present invention, the table set moving device comprises driven pins respectively formed on a pair of side plates of the table set supporting structure, and a pair of gears which are rotatably supported and which are respectively engaged with the driven pins on the pair of side plates. The table set supporting structure is moved vertically by forward and backward rotation of the pair of gears.

In this embodiment, there is an additional advantage that the table set moving device can be realized with a comparative simple structure.

In a still further preferred embodiment of the card feeding apparatus according to the present invention, there are further provided with operating protrusions arranged on respective arrangement lines extending vertically on a side plate of the table set supporting structure, and sensors provided on the respective arrangement lines for sensing the corresponding operating protrusions. The position of the table set supporting structure during its vertical motion is detected based on combination of output signals of the sensors.

In this embodiment, there is an additional advantage that position of the table set supporting structure during its vertical motion can be detected with a comparative simple structure.

In a still further preferred embodiment of the card feeding apparatus according to the present invention, the card conveying device comprises a first roller unit for conveying forward a card which is moved to the card conveying position from the card supplying device; a second roller unit for conveying forward the card which is conveyed on the target table by the first roller unit; and a third roller unit for conveying forward the card which is conveyed forward from the target table by the second roller unit.

In this embodiment, since the conveying operation of a card is divided into three parts and these three parts are assigned respectively to the first to third roller units, there is an additional advantage that the complicated conveying operation of a card by the card conveying device can be realized with a comparative simple structure.

In a still further preferred embodiment of the card feeding apparatus according to the present invention, all the tables in the table set are vertically arranged at a fixed pitch and are independently movable forward and backward in the table set supporting structure, and a sliding mechanism is provided for the table set. When any one of the tables in the table set is designated as the target table, the target table is moved backward to the card conveying position in response to the card feeding signal using the sliding mechanism in synchronization with a vertical motion of the table set supporting structure to a designated position by the table set moving device.

In this embodiment, there is an additional advantage that the target table can be surely moved to the card conveying position by simply moving the table set supporting structure vertically to the designated position designated by the card feeding signal.

In a still further preferred embodiment of the card feeding apparatus according to the present invention, when all the tables in the table set are defined as first to n-th tables, where n is an integer greater than unity, the controller performs a card placing process and a card feeding process. In the card placing process, cards are successively supplied from the card supplying device to the card conveying position and are successively placed on the first to n-th tables. In the card feeding process, the card placed on the target table which is designated from the first to n-th tables is conveyed forward in response to the card feeding signal.

In this embodiment, initially, cards from the card supplying device are successively placed on the first to n-th tables in the table set in the card placing process and thereafter, the card placed on the target table is selectively conveyed forward in response to the card feeding signal in the card feeding process. Thus, there is an additional advantage that cards can be surely placed on all the first to n-th tables in the table set before starting the card feeding process.

In this embodiment, it is preferred that a placing motion of an additional card which is supplied from the card supplying device on the target table is performed in synchronization with a conveying motion of the card held on the target table. In this case, there is an additional advantage that the placing motion of the additional card on the target table can be started immediately after completing the conveying motion of the card placed on the target table, and that this can be realized easily by using the card conveying device commonly for the placing motion of the additional card on the target table and the conveying motion of the card on the target table. These additional advantages will raise the operation speed or operation efficiency of the card feeding apparatus of the present invention and simplify the structure of the card conveying device.

BRIEF DESCRIPTION OF THE DRAWINGS

In order that the present invention may be readily carried into effect, it will now be described with reference to the accompanying drawings.

DETAILED DESCRIPTION OF THE INVENTION

Figure 1:
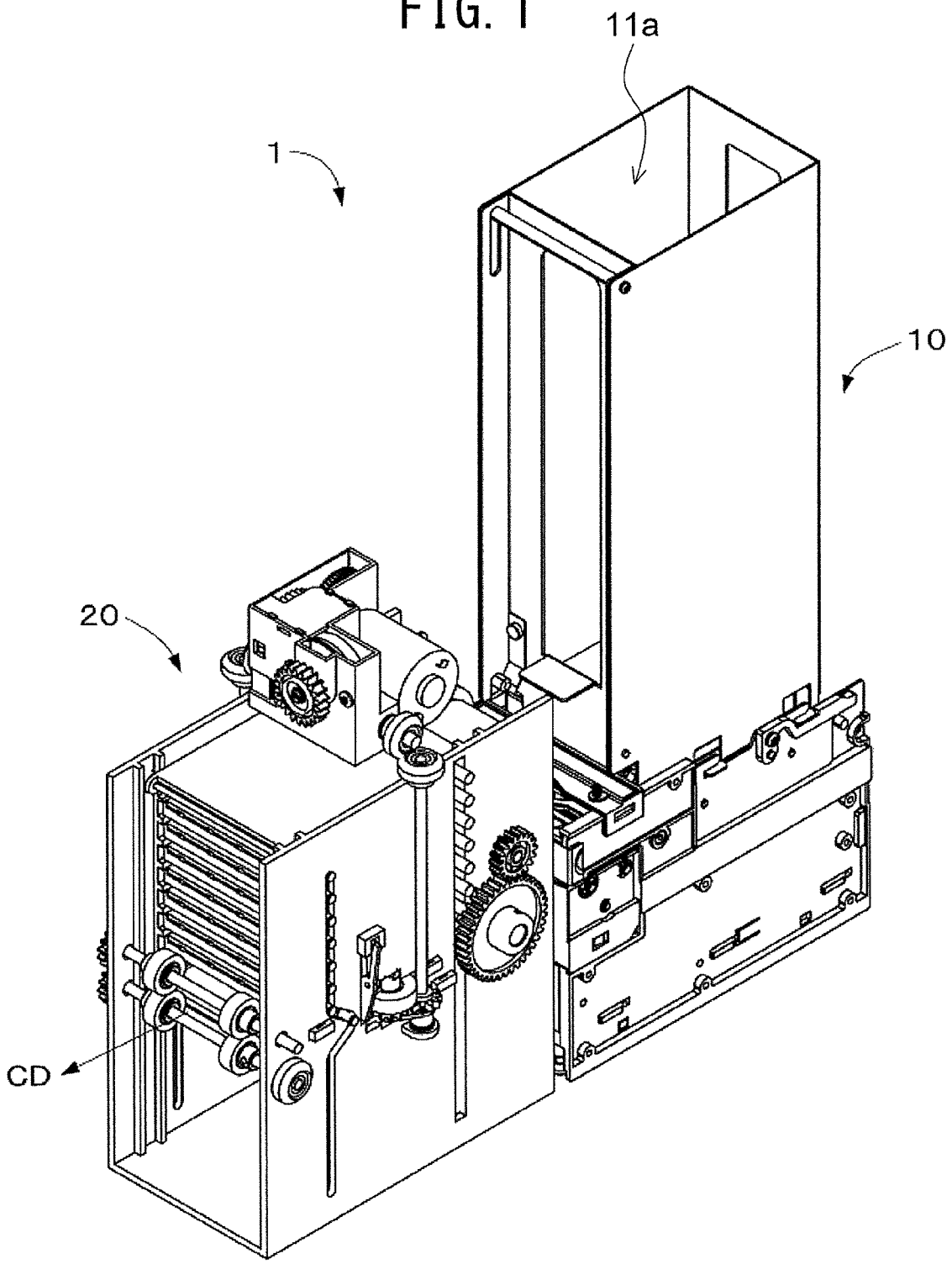
FIG. 1 is a perspective view showing a card feeding apparatus according to an embodiment of the present invention.

Preferred embodiments of the present invention will be described in detail below while referring to the drawings attached.

FIG. 1 shows a card feeding apparatus 1 according to an embodiment of the present invention. This apparatus 1 comprises a card supplying device 10 that separates a desired card C from a card stack in which a plurality of cards C are stacked vertically in a line and that supplies the card C thus separated, and a card holding and feeding device 20 that holds temporarily the cards C supplied from the card supplying device 10 and that feeds selectively the cards C thus held in a predetermined feeding direction CD.

Card Supplying Device

Figure 2:
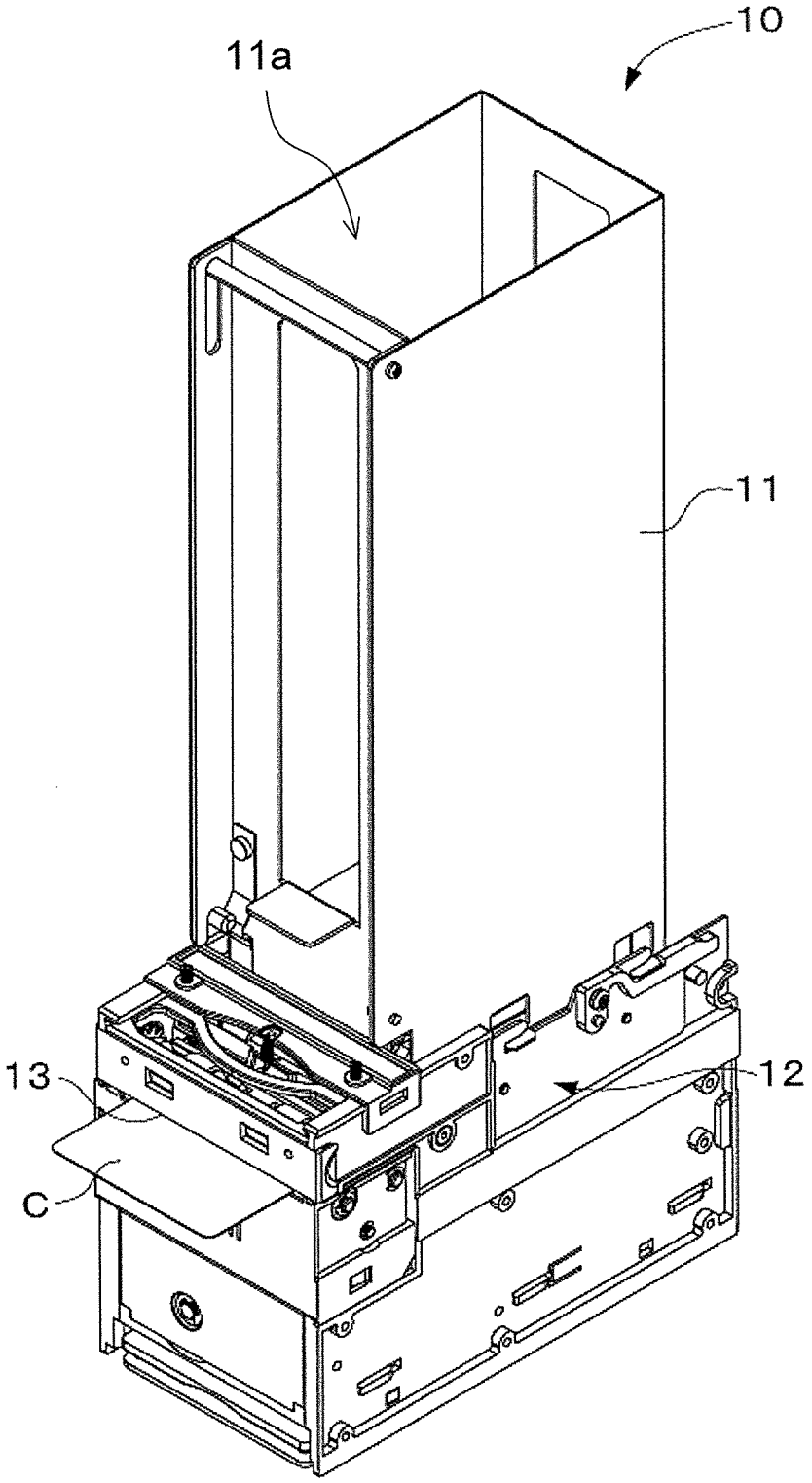
FIG. 2 is a perspective view showing the card supplying device that constitutes a part of the card feeding apparatus of FIG. 1.

First, the card supplying device 10 will be explained below with reference to FIG. 2. This device 10 comprises a card storing section 11 for storing a plurality of cards C in a vertically stacked form, and a card conveying section 12 for selectively conveying the lowest-positioned card C from the card stack stored in the card storing section 11 toward a supply port 13 of the device 10.

In the card stack of the card storing section 11, the opposing faces of the two adjoining cards C are in contact with each other, and all the stacked cards C are arranged so as to form a quadrangular prism.

The card storing section 11 has one storing space 11*a* whose horizontal cross section is rectangular and whose size is slightly larger than the card C. Cards C are stacked vertically in the storing space 11*a*. The lowest-positioned card C is selectively separated from the remainder of the card stack and fed to the supply port 13 by the card conveying section 12. This operation is repeated as necessary.

Cards C are vertically stacked in the storing space 11*a* so as to be kept in their horizontal positions. Only one card stack can be formed in the storing space 11*a*.

The card conveying section 12 comprises a base (not shown) to which a card C is pressed during conveyance, a conveying member (not shown) on which a card C is to be placed so as to be sandwiched by the base and the conveying member, and a flat loop moving means for moving the conveying member in such a way as to draw a flat loop. By the motion of the flat loop moving means, the card C held by the base and the conveying member is fed forward in the predetermined direction to the supply port 13 utilizing friction force among the card C, the base, and the conveying member.

Since the structure of the card supplying device 10 is the same as that of the card feeding apparatus disclosed in the Japanese Patent No. 4991995 as the aforementioned first prior art, further explanation for the device 10 will be omitted here.

It is needless to say that any other device having a card storing function in the form of card stack and a card supplying function to the supply port 13 from the card stack may be used instead of the aforementioned card supplying device 10.

Card Holding and Feeding Device

Next, the card holding and feeding device 20 will be explained in detail below with reference to FIGS. 3 to 5.

Figure 10:
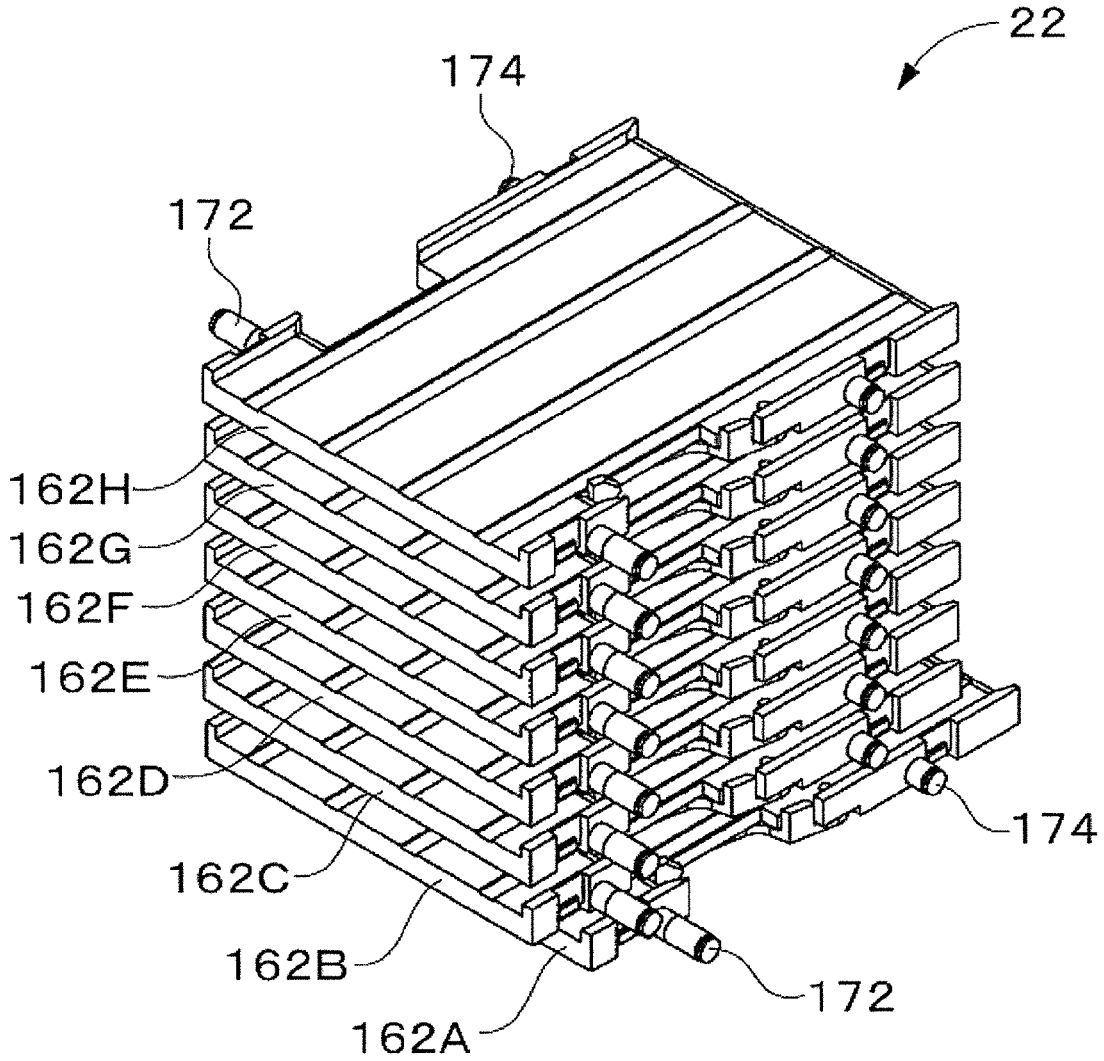
FIG. 10 is a perspective view showing the table set that constitutes a part of the card holding and feeding device of FIG. 3.

The card holding and feeding device 20 comprises a body 21 with a U-shaped cross section; a table set 22 formed by eight tables 162A to 162H (see FIG. 10) for respectively holding cards C; a frame 23 which is located in the body 21 and which encloses the table set 22 (i.e., all the tables 162A to 162H); and a lifting mechanism 24 for moving the frame 23 upward and downward.

The card holding and feeding device 20 further comprises a card conveying device 28 for conveying cards C supplied from the card supplying device 10 to the respective tables 162A to 162H, and for feeding the cards C held on the tables 162A to 162H in the predetermined card feeding direction CD. The card conveying device 28 includes a first roller unit 25, a second roller unit 26, and a third roller unit 27.

Moreover, the card holding and feeding device 20 further comprises a card sensor device 30 for sensing the position of a card C held on each of the tables 162A to 162H; a first driving device 31 for driving the lifting mechanism 24; a second driving device 32 for driving the first, second and third roller units 25, 26 and 27 of the card conveying device 28; a frame position sensor device 33 for sensing the position of the frame 23; and a controller 40 (see FIG. 26) for controlling the operations of the card supplying device 10 and the card storing and feeding device 20.

Body

Next, the body 21 of the card holding and feeding device 20 will be explained in detail with reference to FIG. 6.

Figure 6:
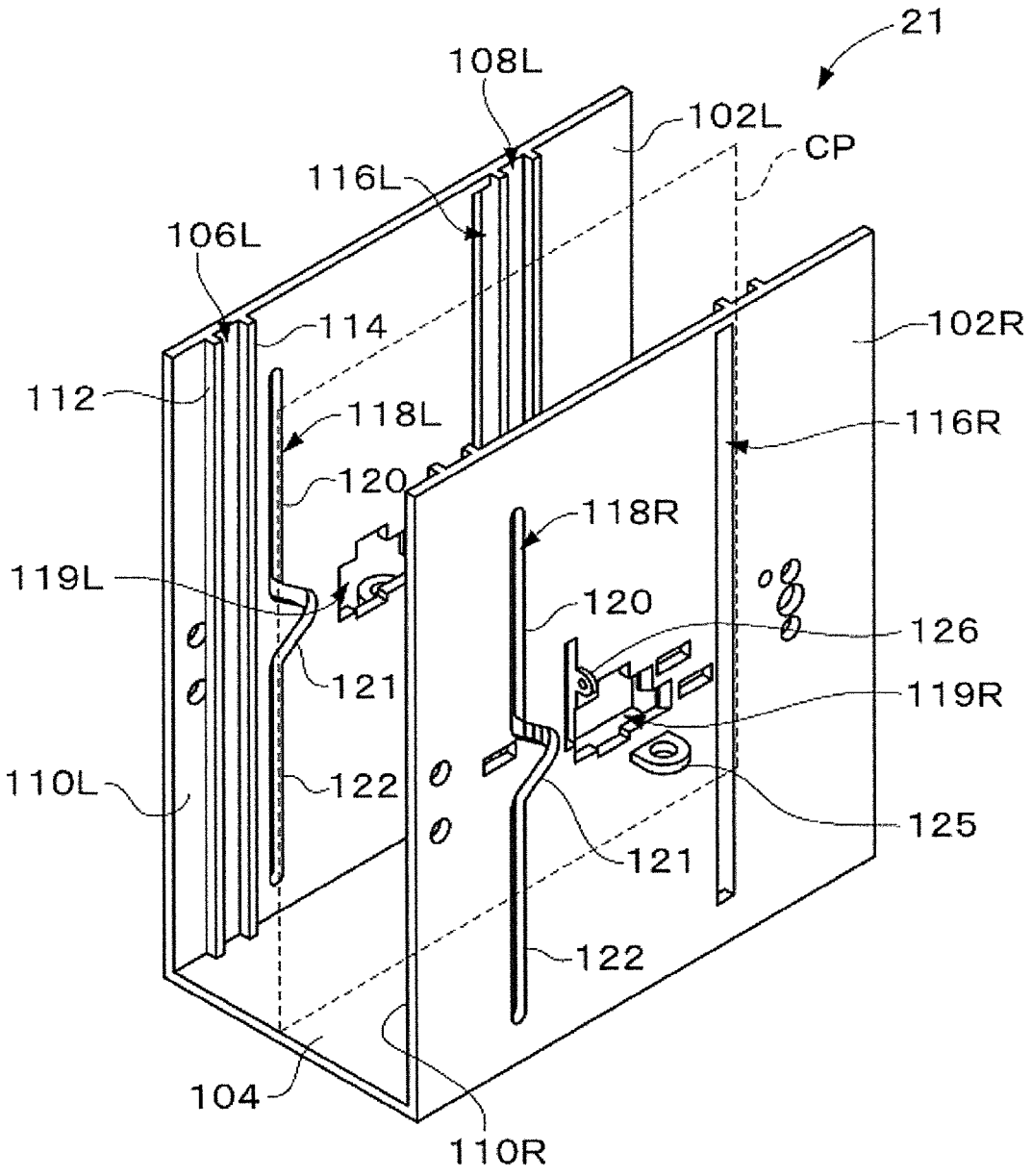
FIG. 6 is a perspective view showing the body that constitutes a part of the card holding and feeding device of FIG. 3.

As shown in FIG. 6, the body 21 of the card storing and conveying device 20 has the function of supporting the frame 23 so as to be movable upward and downward and the function of an enclosure on which the lifting mechanism 24, the card conveying device 28, the first driving device 31, and the second driving device 32 are mounted. The body 21 comprises a right sidewall 102R and a left sidewall 102L which are arranged in parallel to each other, and a bottom wall 104 that interconnects the lower ends of the right and left sidewalls 102R and 102L. The right sidewall 102R, the left sidewall 102L, and the bottom wall 104 are all plate-shaped and formed integrally. In the right sidewall 102R, vertical guide groves 106R and 108L for guiding corresponding guide rollers 148 provided on the frame 23, which will be described in detail later, are formed. Similarly, in the left sidewall 102L, vertical guide groves 106L and 108L for guiding corresponding guide rollers 148 provided on the frame 23, which will be described later, are formed. These vertical guide grooves 106R, 106L, 108R and 108L are formed to extend upward in the vertical direction from the inner surface of the bottom wall 104, reaching the upper end of the right or left sidewall 102R or 102L. Each of the vertical guide groves 106R, 108R, 106L and 108L is defined by a pair of protruding guide walls 112 and 114 which is formed apart from each other on the inner surface 110R of the right sidewall 102R or the inner surface 110L of the left sidewall 102L.

In the right and left sidewalls 102R and 102L, elongated guide holes 116R and 116L for engaging driven pins 144A to 144H that constitute a part of the lifting mechanism 24 are formed respectively, where the driven pins 144A to 144H are formed on the frame 23. These guide holes 116R and 116L are respectively located at rearward positions (in other words, at positions closer to the card supplying device 10) with respect to the middle of the right and left sidewalls 102R and 102L, and respectively formed to extend vertically from the vicinities of the lower ends of the right and left sidewalls 102R and 102L to the vicinities of the upper ends thereof.

Moreover, cam holes 118R and 118L for slidably moving the table set 22 are respectively formed in the right and left sidewalls 102R and 102L. Each of the cam holes 118R and 118L has first and second linear parts 120 and 122 and a bended part 121 formed between the first and second linear parts 120 and 122. The bended part 121 has a shape like a sideways V character. The cam holes 118R and 118L are respectively located at frontward positions (in other words, at positions closer to the front end) with respect to the middle of the right and left sidewalls 102R and 102L, and respectively located adjacent to the guide grooves 106R and 106L.

In approximately the central areas of the right and left sidewalls 102R and 102L, roller device receiving apertures 119R and 119L for receiving respectively the right and left roller subunits 230R and 230L of the second roller unit 26 are respectively formed. Each of the guide grooves 106R and 106L, the guide grooves 108R and 108L, the guide holes 116R and 116L, the cam holes 118R and 118L, and the roller device receiving apertures 119R and 119L has a symmetrical shape with respect to the central plane CP (see FIG. 6) of the body 21 and is arranged at a symmetrical position with respect to the same central plane CP.

Frame

Figure 7:
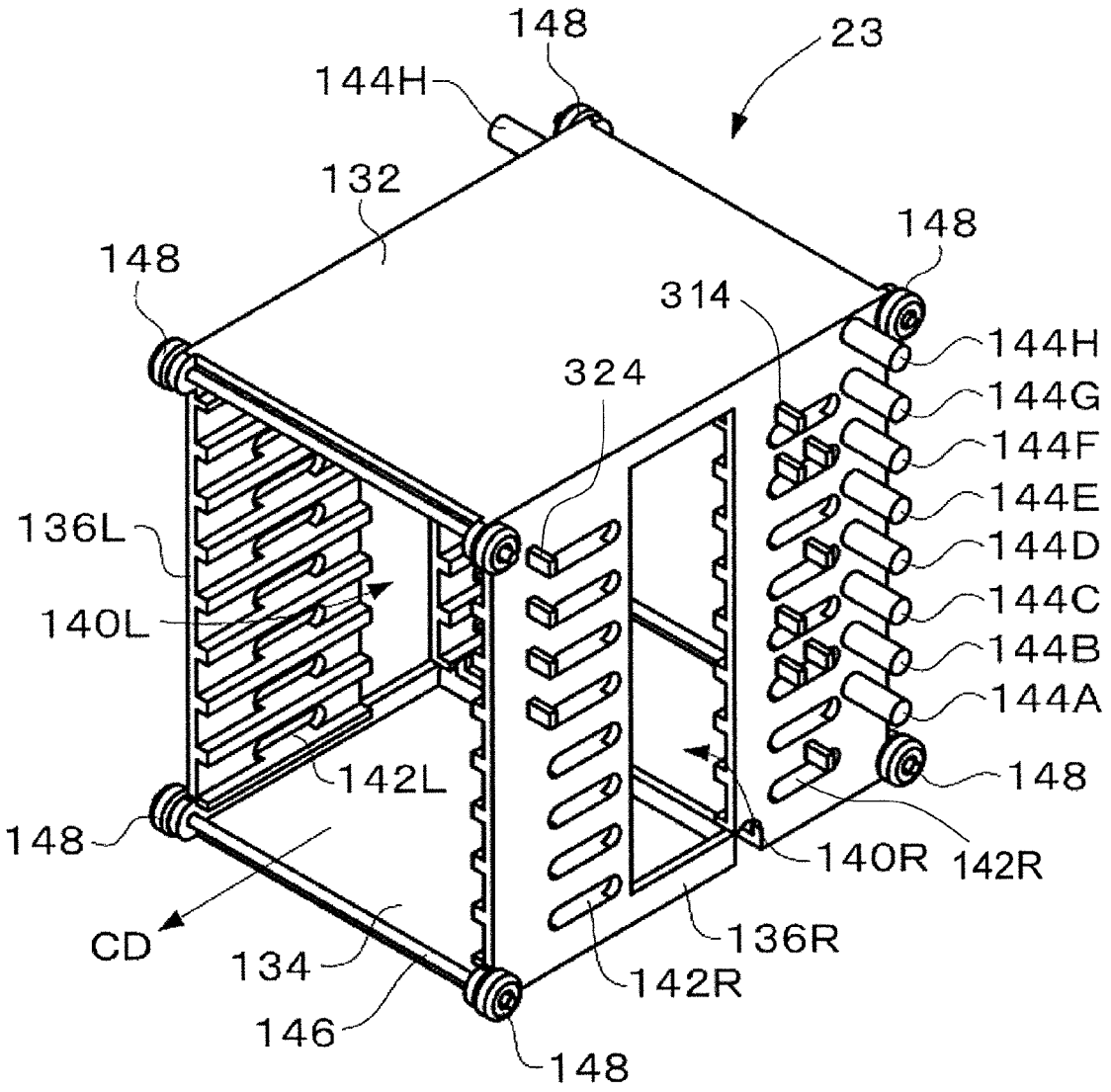
FIG. 7 is a perspective view showing the frame that constitutes a part of the card holding and feeding device of FIG. 3.
Figure 8:
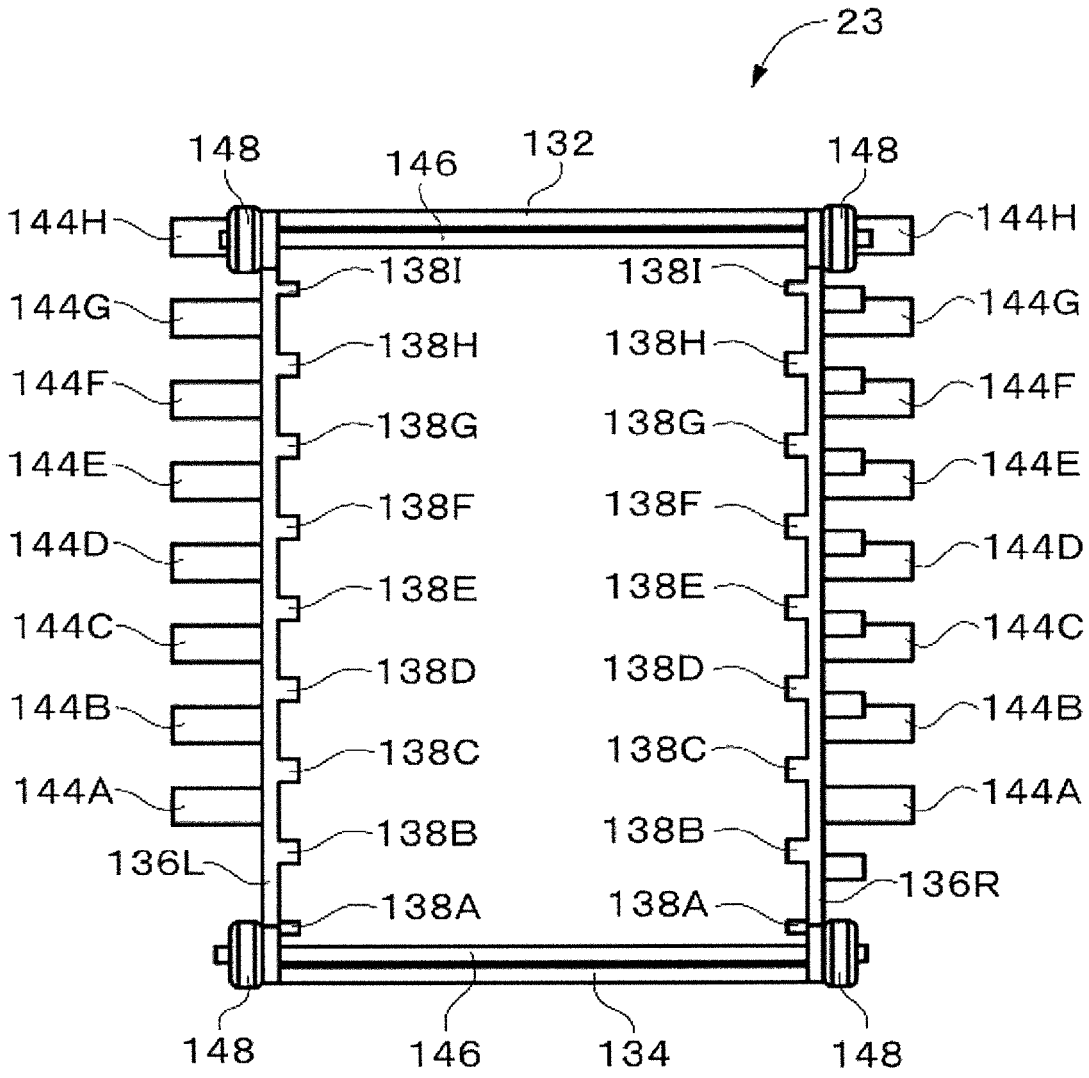
FIG. 8 is a front view showing the frame of FIG. 7.
Figure 9:
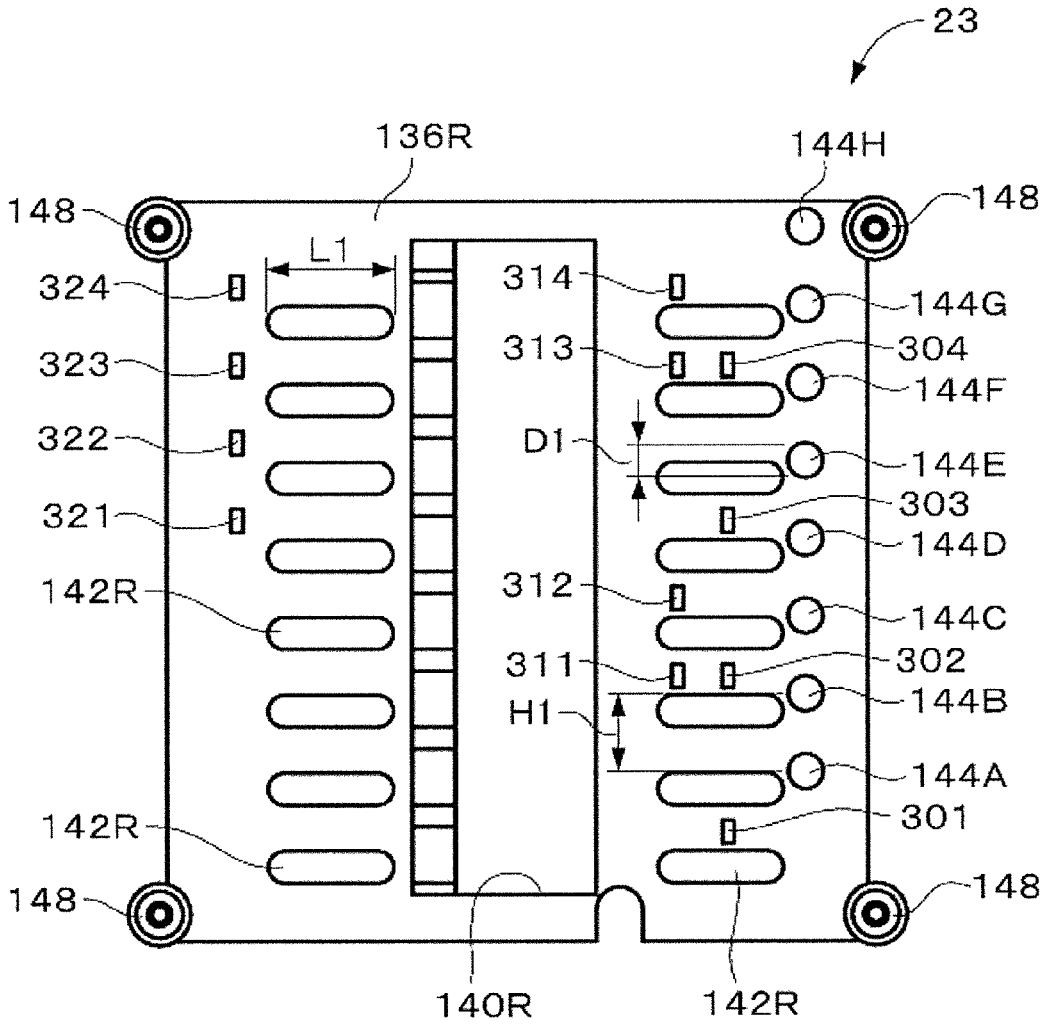
FIG. 9 is a right side view showing the frame of FIG. 7.

Next, the frame 23 of the card holding and feeding device 20 will be explained in detail with reference to FIGS. 7 to 9.

The frame 23 has the function of enclosing the table set 22 (i.e., the tables 162A to 162H) so as to be moved slidably forward and backward within the frame 23 and is movable in a vertical direction within the body 21 using the lifting mechanism 24. The frame 23 is box-shaped, in other words, it has the shape of a rectangular parallelepiped whose front and rear surfaces are opened, as shown in FIG. 7. The frame 23 comprises a top plate 132, a bottom plate 134, and right and left side plates 136R and 136L. The top and bottom plates 132 and 134 are rectangular and are parallel to each other. The top plate 132 is connected to the upper ends of the right and left side plates 136R and 136L, and the bottom plate 134 is connected to the lower ends of the side plates 136R and 136L.

On each inner surface of the right and left side plates 136R and 136L, nine table supporting members 138A to 138I are formed in order to slidably support the table set 22. Each of the table supporting members 138A to 138I, which is rectangular in the vertical cross section, is laterally protruded inward from the inner surface of the right or left side plate 136R or 136L and is extended parallel to the card feeding direction CD. Rectangular openings 140R and 140L are respectively formed in the right and left side plates 136R and 136L so as to extend vertically, as shown in FIG. 7. These openings 140R and 140L are provided for enabling rollers 232 of right and left side roller sections 230R and 230L of the second roller unit 26 (see FIG. 19) to enter the inside of the frame 23.

In the right and left side plates 136R and 136L, guide holes 142R and 142L for guiding guide pins 172 and 174 (see FIG. 10) of the tables 162A to 162H are formed. The guide holes 142R and 142L, which are approximately elliptic in shape, extend parallel to the card feeding direction CD. The guide holes 142R in the side plate 136R are arranged vertically at even intervals in the front and rear areas of the plate 136R with respect to the opening 140R, and the guide holes 142L on the side plate 136L are arranged vertically at even intervals in the front and rear areas of the plate 136L with respect to the opening 140L. The guide holes 142R are arranged at the front and rear areas of the opening 140R on the side plate 136R. Each of the guide holes 142R and 142L is located between adjoining two of the table supporting members 138A to 138I. The guide holes 142R and 142L have the same length L1 which is set in accordance with the horizontal moving distance of the table set 22.

In the vicinities of the rear ends of the right and left side plates 136R and 136L, eight driven pins 144A to 144H for moving the frame 23 upward and downward are provided. The driven pins 144A to 144H have the same columnar shape whose diameter is D1 and are arranged vertically at a predetermined pitch H1, as shown in FIG. 9.

At the respective corners of the right and left side plates 136R and 136L, guide rollers 148 are provided. Two of the guide rollers 148 located at corresponding positions on the side plates 136R and 136L are rotatably supported by a corresponding support shaft 146 which intervenes between the guide rollers 148 in question. The guide rollers 148 are respectively engaged with the corresponding vertical guide groves 106R, 106L, 108R, and 108L of the body 21, thereby movably supporting the frame 23 in the vertical direction within the body 21.

On the outer surface of the right side plate 136R, operating protrusions 301 to 304, 311 to 314, and 321 to 324 are formed in order to find the position of the frame 23 during its vertical movement. Detailed explanations about the operating protrusions 301 to 304, 311 to 314, and 321 to 324 will be given later.

Table Set

FIGS. 10 to 15 show the structure of the table set 22 of the card holding and feeding device 20. As seen from FIG. 10, the table set 22 comprises the eight tables 162A to 162H. Since these tables 162A to 162H have the same structure, only the explanation about the table 162A is presented here and the explanation about the remaining tables 162B to 162H is omitted for simplification of description.

Figure 11:
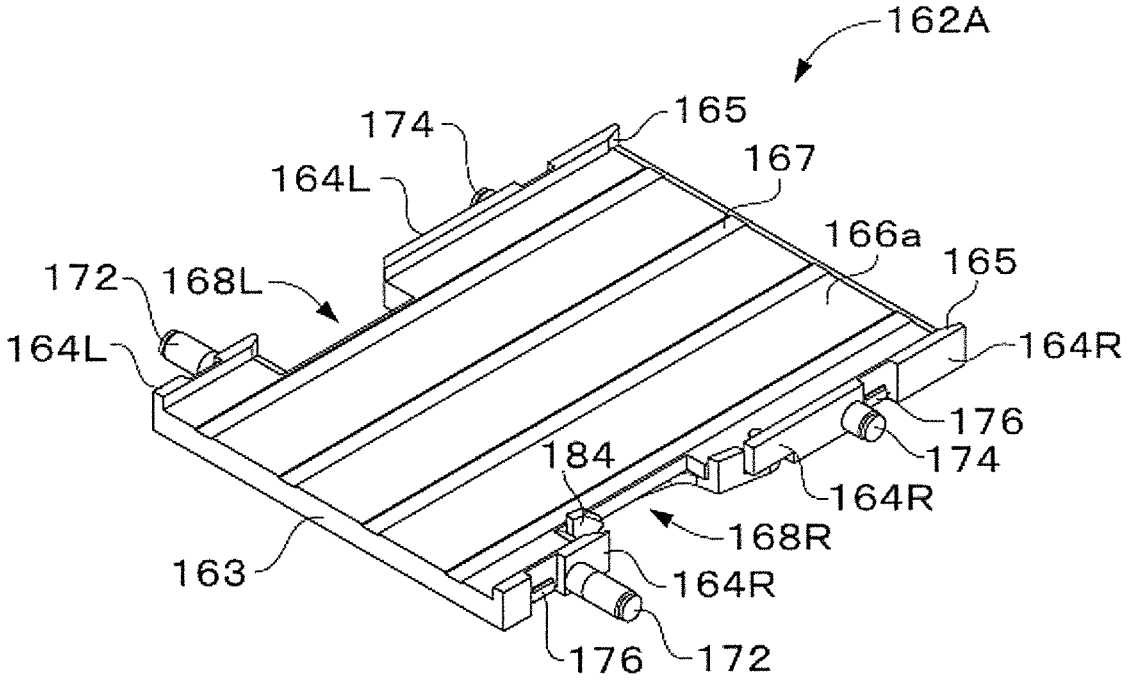
FIG. 11 is a perspective view showing the table that constitutes a part of the table set of FIG. 10.

The table 162A has the function of carrying a card C supplied from the card supplying device 10 and holding the same temporarily. As shown in FIG. 11, the table 162A has a shallow U-shaped cross section, and comprises a plate-shaped main part 163 and sidewalls 164R and 164L which are respectively formed at the right and left side edges of the main part 163. The sidewalls 164R and 164L are provided for guiding a card C. The interval between the sidewalls 164R and 164L is slightly larger than the width of a card C. This is to facilitate straight feeding action of a card C from the table 162A. Taper parts 165 are respectively formed at the rear ends of the sidewalls 164R and 164L, thereby increasing the interval between the sidewalls 164R and 164L gradually. This is to facilitate reception of a card C supplied from the card supplying device 10. Four grooves 167 are formed in the upper surface 166*a* of the main part 163 so as to extend along the forward/backward direction (or the longitudinal axis) of the main part 163. This is to prevent a card C from becoming in close contact with the upper surface 166*a* when the card C is placed on the same upper surface 166*a*. As shown in FIG. 11, two cutout portions 168R and 168L, which are approximately rectangular in a plan view, are formed at the right and left side edges of the main part 163, respectively. The cutout portions 168R and 168L are respectively located at the positions which are inside with respect to the right and left side edges of the main part 163 and which are closer to the front end with respect to the middle of the main part 163.

A guide pin 172 and a guide pin 174 are formed on each of the sidewalls 164R and 164L. The front guide pin 172 is located at a position closer to the front end of the table 162A, and the rear guide pin 174 is located at a position closer to the rear end thereof. All the guide pins 172 and 174 are protruded sideways from each of the sidewalls 164R and 164L. The front guide pins 172 on the sidewalls 164R and 164L penetrate the corresponding guide holes 142R and 142L of the frame 23, and are engaged with the corresponding cam holes 118R and 118L of the body 21. The rear guide pins 174 on the sidewalls 164R and 164L are inserted into the corresponding guide holes 142R and 142L of the frame 23 and engaged therewith. Due to such the structures and relationships, when the frame 23 is moved upward or downward using the lifting mechanism 24, the front and rear guide pins 172 and 174 are guided by the guide holes 142R and 142L of the frame 23 and at the same time, the front guide pins 172 are guided by the bended parts 121 of the cam holes 118R and 118L of the body 21. As a result, the front guide pins 172 engaged with the cam holes 118R and 118L serve as "cam followers", thereby sliding the table 162A back and forth. This means that the combination of the guide pins 172 and 174, the guide holes 142R and 142L, and the cam holes 118R and 118L serves as "a sliding mechanism" that moves selectively the table 162A forward and backward.

In this way, the aforementioned sliding mechanism realizes selectively sliding of a specified one of the tables 162A to 162H along the card feeding direction so as to be interlocked with vertical movement of the table set 22. Thus, the specified table can be slid toward the supply port 13 of the card supplying device 11 using the sliding mechanism when the placement operation of an additional card C is carried out, in other words, an additional card C supplied from the card supplying device 10 is placed on the specified table. This means that an interval can be formed between the card supplying device 10 and the frame 23. As a result, there is an additional advantage that interference between the card supplying device 10 and the frame 23 can be surely avoided. Moreover, since no driving mechanism is necessary for realizing the aforementioned sliding motions of the tables 162A to 162H, there is another additional advantage that the fabrication cost of the card feeding apparatus 1 can be prevented from increasing.

Figure 14:
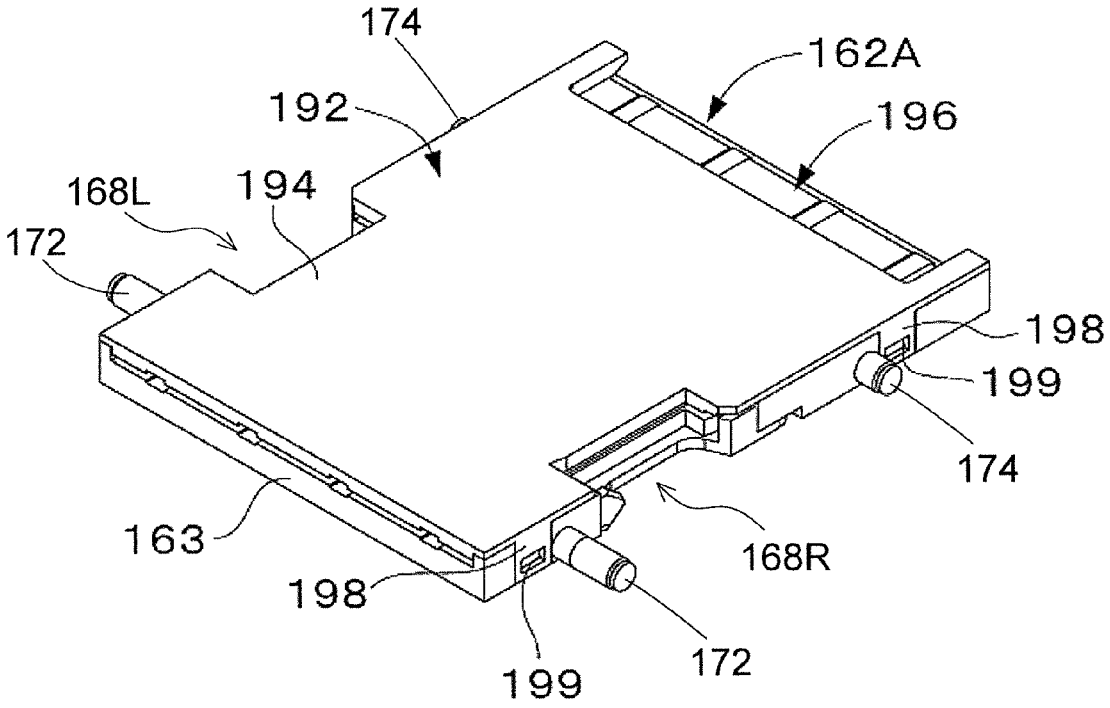
FIG. 14 is a perspective view showing the state of the table of FIG. 11 to which a cover is attached.

On the sidewalls 164R and 164L of the table 162A, four engaging parts 176 are formed to make it possible to attach a cover 192 (which is shown in FIG. 14 and which will be explained later) to the table 162A. Two of the engaging parts 176 are respectively located at positions closer to the front ends of the sidewalls 164R and 164L, and the other two are respectively located at positions closer to the rear ends thereof.

Figure 12A:
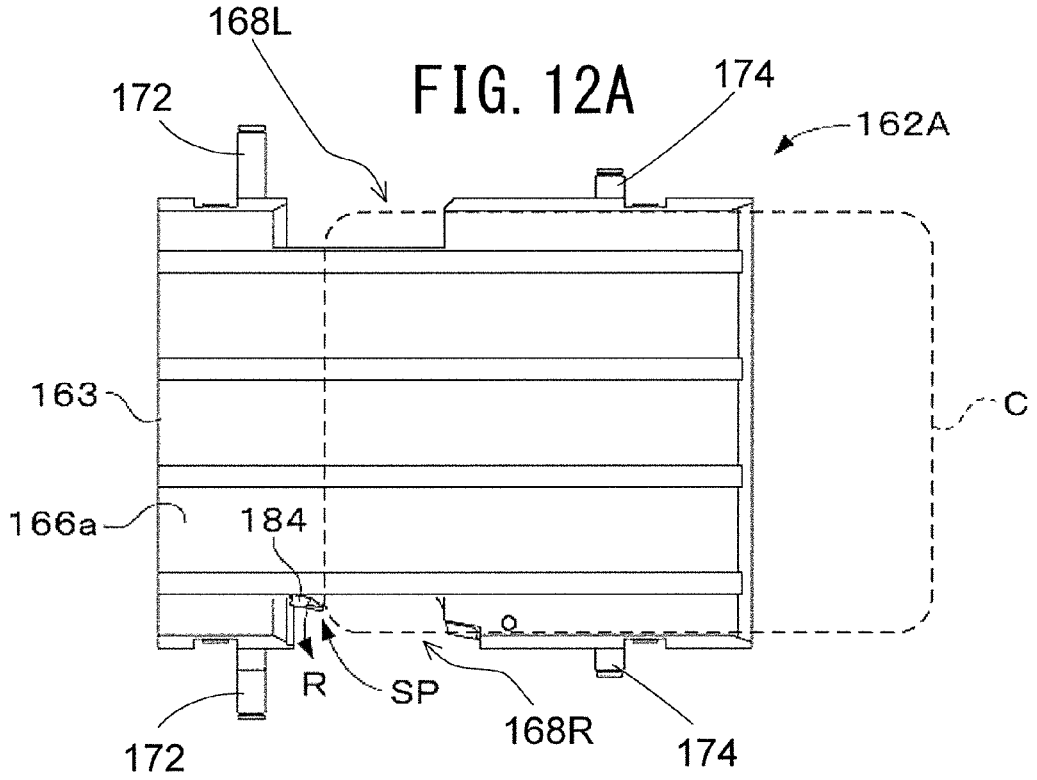
FIG. 12A is a plan view showing the state of the table of FIG. 11 before a card is placed and held thereon.
Figure 12B:
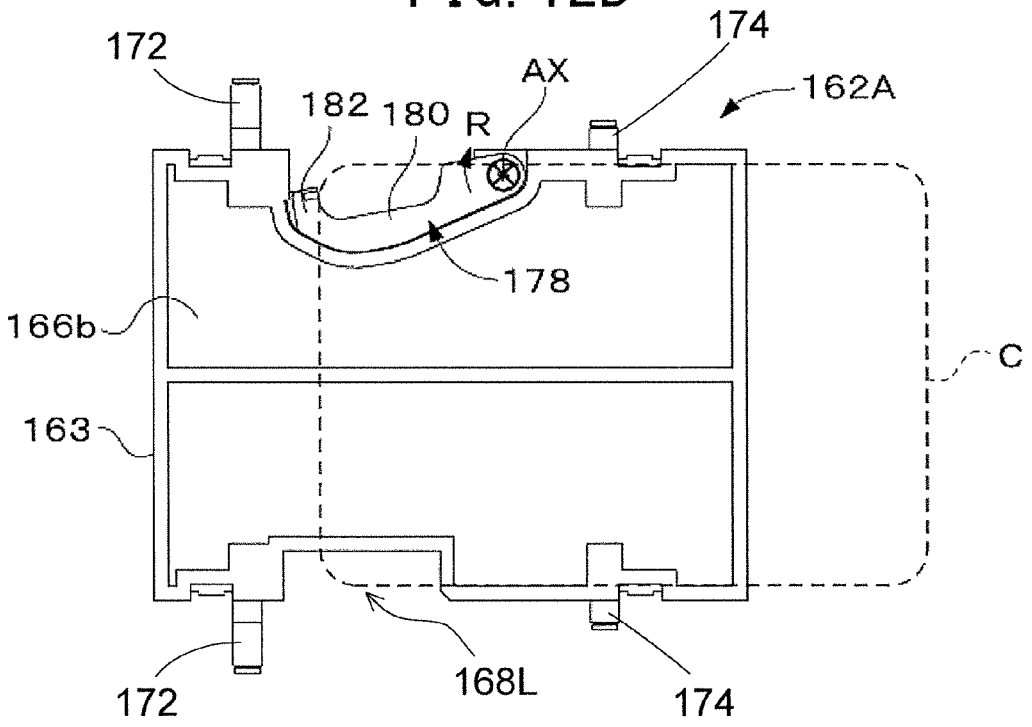
FIG. 12B is a bottom view showing the state of the table of FIG. 11 before a card is placed and held thereon.
Figure 13A:
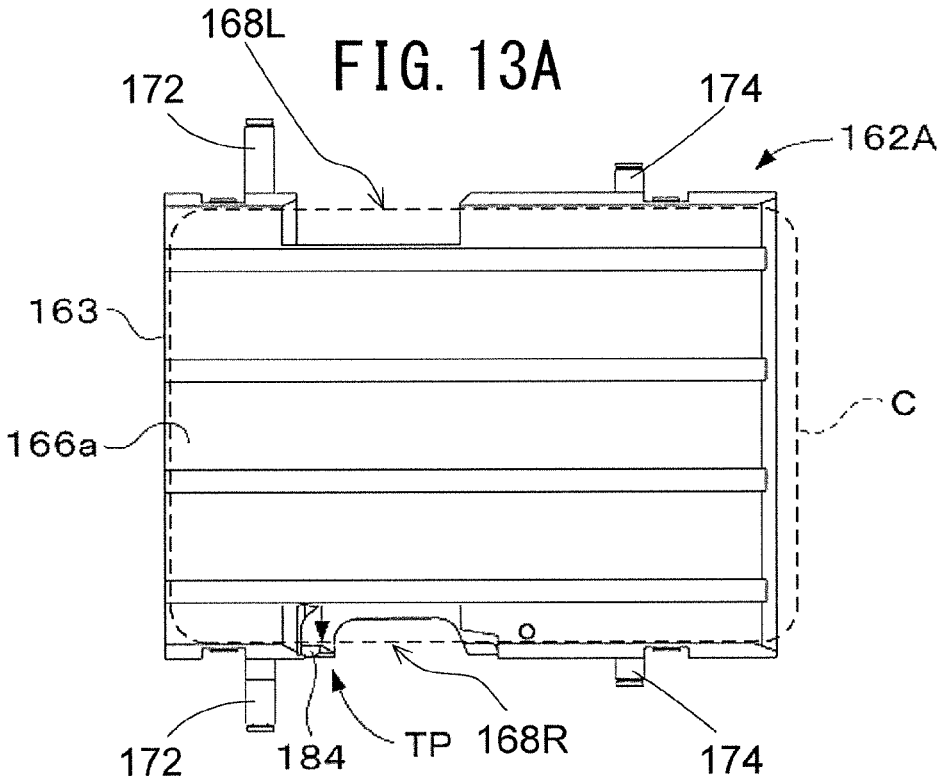
FIG. 13A is a plan view showing the state of the table of FIG. 11 after a card is placed and held thereon.
Figure 13B:
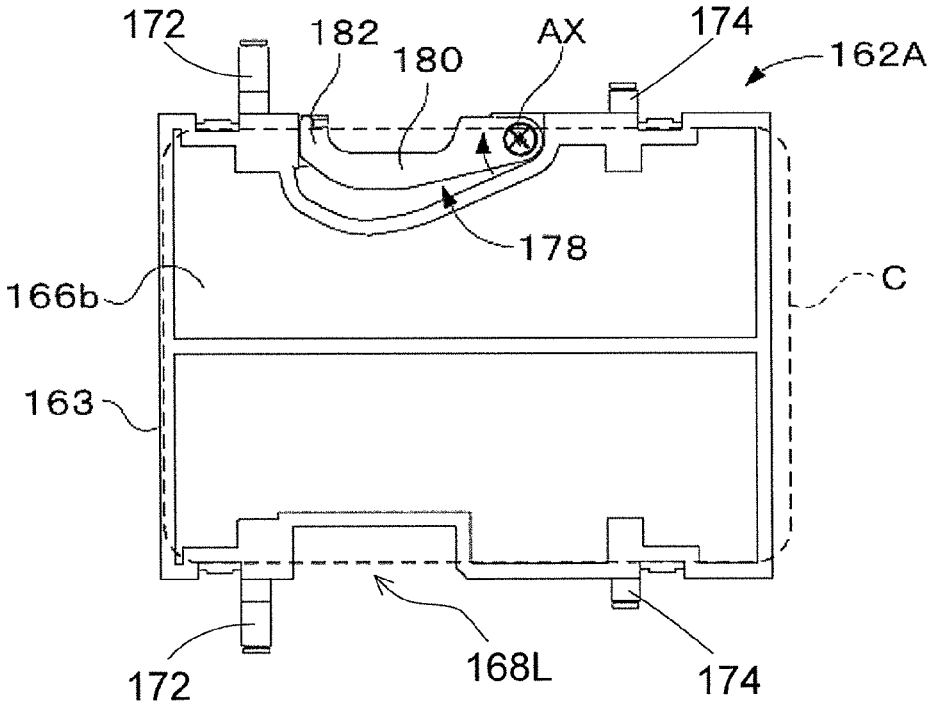
FIG. 13B is a bottom view showing the state of the table of FIG. 11 after a card is placed and held thereon.

As shown in FIGS. 12A and 12B, on the back of the table 162A, i.e., on the lower surface 166*b* of the main part 163, a rocking lever 178 is provided so as to be rockable around a predetermined axis AX at an overlapping position with the cutout portion 168R. The plan shape of the lever 178 is like a C character. The lever 178 has a main part 180 and a top end 182 formed at the opposite end of the lever 178 to the axis AX. A protrusion 184 is formed at the top end 182 of the lever 178 so as to protrude upward from the upper surface 166*a* of the main part 163, as clearly shown in FIG. 11. The protrusion 184 is extended upward from the lower surface 166*b* of the main part 163. The lever 178 is biased or urged toward the standby position SP (see FIGS. 12A and 12B) with a biasing or urging member (not shown). If a card C is placed on the table 162A in this state, the card C is contacted with the protrusion 184 and then, the lever 178 is rocked outward (i.e., rocked in the clockwise direction R in FIG. 12B) by the card C against the biasing/urging force of the biasing/urging member. As a result, the lever 178 is moved to the protruded position TP where the outer face of the protrusion 184 is flush with the outer surface of the right sidewall 164R, as shown in FIGS. 13A and 13B. In this way, the card C can be detected with the card sensor device 30 which will be described later.

Since the rocking lever 178 is provided on each of the tables 162A to 162H, there is an additional advantage that the presence and absence of a card C on each of the tables 162A to 162H can be found with a comparative simple structure.

Next, a table cover 192 will be explained below with reference to FIG. 14.

As shown in FIG. 14, a table cover 192 is provided for the table 162A. The cover 192 has the function of stabilizing a card C placed on the table 162A. The cover 192, which has approximately the same contour as the table 162A, comprises a main part 194 and four connecting parts 198 which extend downward from the main part 194 and which are approximately rectangular. The main part 194 comprises an approximately rectangular cutout portion 196 at its rear end. The rear end of a card C placed on the table 162A is exposed through the cutout portion 196. An engaging hole 199 is formed at a corresponding position to each engaging part 176 of the table 162A. When the cover 192 is attached to the table 162A from an upper position, the four engaging parts 176 of the table 162A are engaged with the respective engaging holes 199 of the cover 192, thereby fixing the cover 192 to the table 162A. Needless to say, the cover 192 is provided for each of the remaining tables 162B to 162H also, as shown in FIG. 15.

Figure 15:
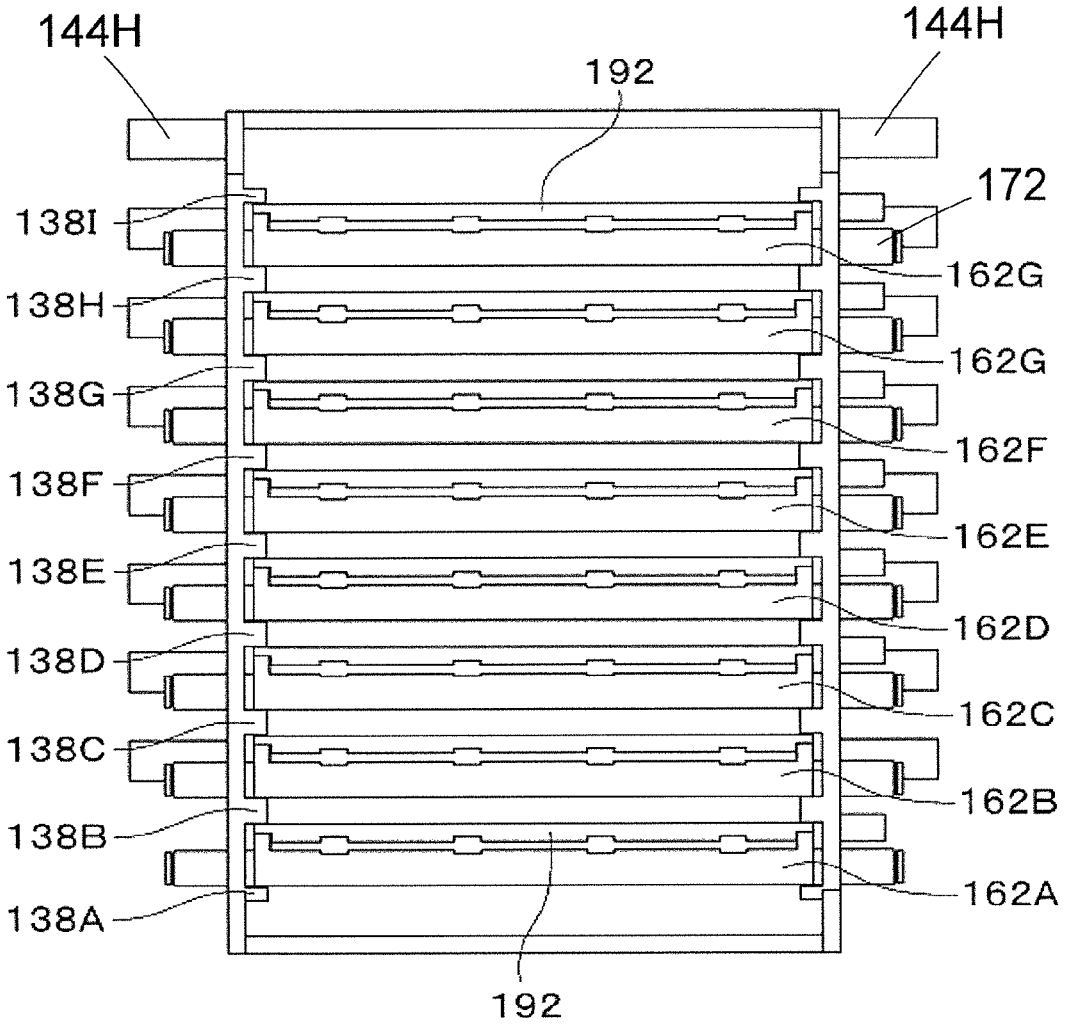
FIG. 15 is a front view showing the state of the table of FIG. 14, where the eight tables are enclosed in the frame along with their respective covers.

As shown in FIG. 15, each of the eight tables 162A to 162H that constitute the table set 22 is disposed at the position between adjoining two of the table supporting members 138A to 138I. Concretely speaking, the table 162A is disposed at the position between the table supporting members 138A and 138B. Similarly, the table 162B is disposed at the position between the table supporting members 138B and 138C, the table 162C is disposed at the position between the table supporting members 138C and 138D, the table 162D is disposed at the position between the table supporting members 138D and 138E, the table 162E is disposed at the position between the table supporting members 138E and 138F, the table 162F is disposed at the position between the table supporting members 138F and 138G, the table 162G is disposed at the position between the table supporting members 138G and 138H, and the table 162H is disposed at the position between the table supporting members 138H and 138I. Thus, it may be said that the tables 162A to 162H are arranged so as to correspond to the respective guide holes 142R and 142L of the frame 23.

Lifting Mechanism

Figure 17:
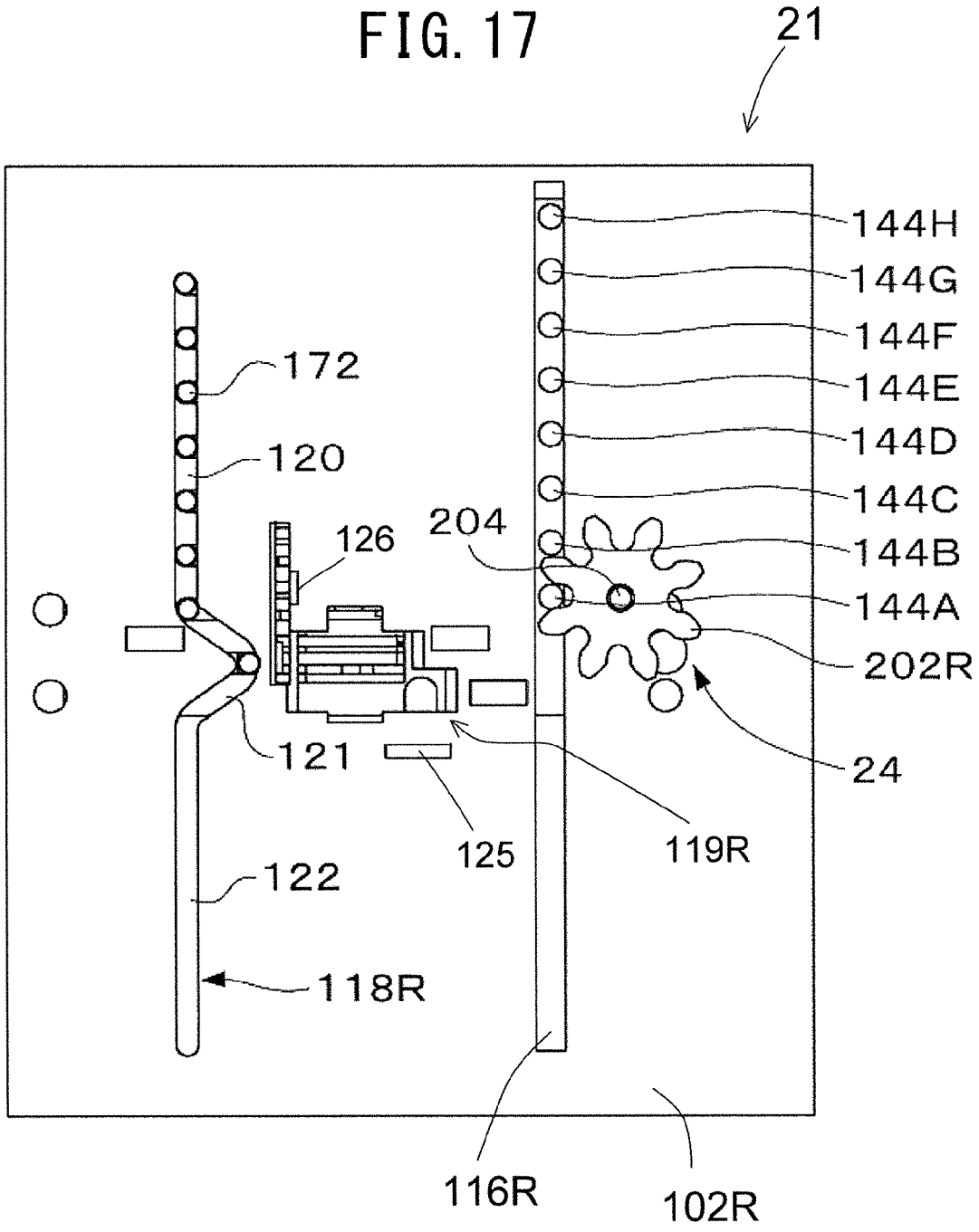
FIG. 17 is a right side view showing the main part of the card holding and feeding device of FIG. 3, where the card conveying device and the driving devices are omitted.
Figure 18:
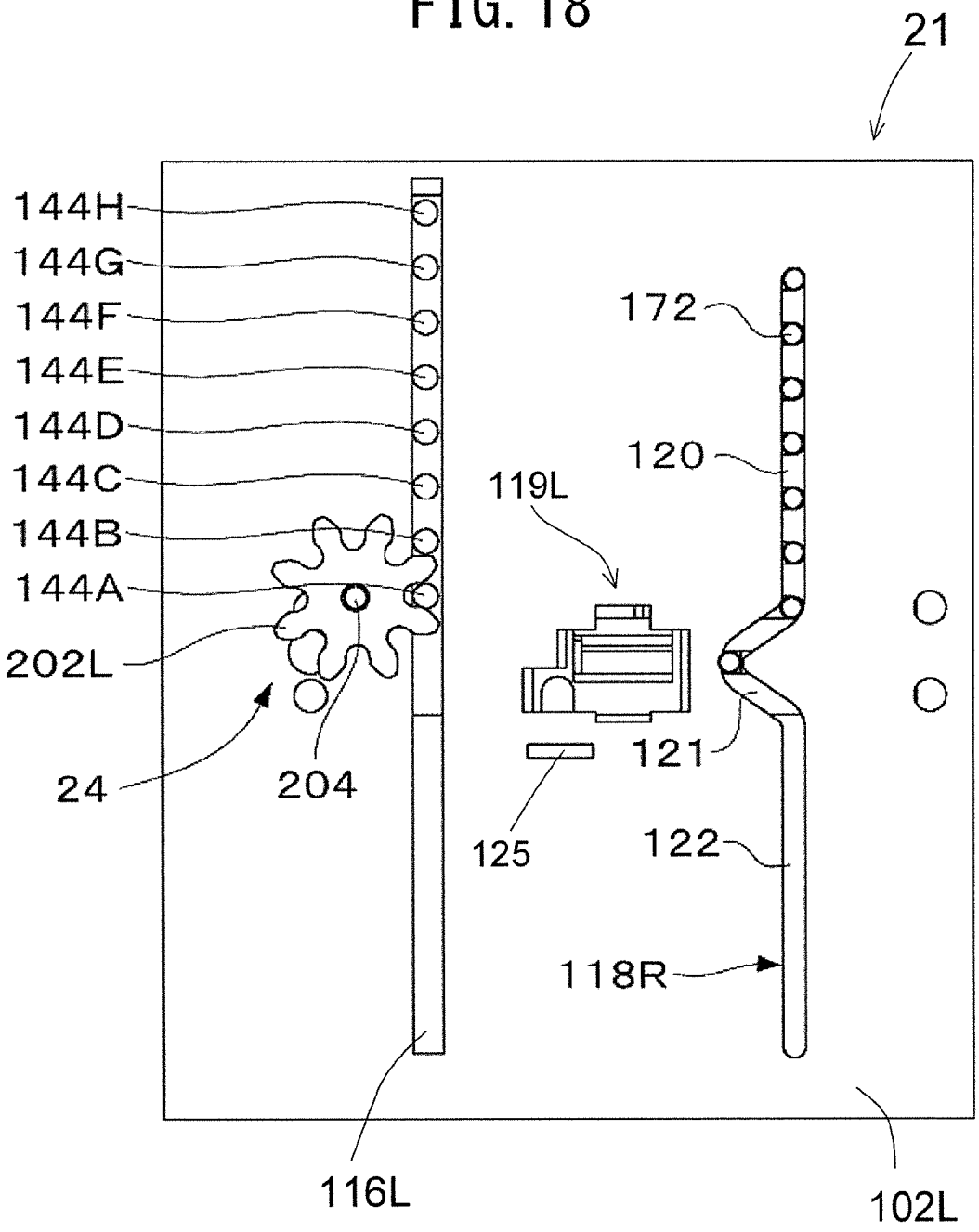
FIG. 18 is a left side view showing the main part of the card holding and feeding device of FIG. 3, where the card conveying device and the driving devices are omitted.

Subsequently, the lifting mechanism 24 of the card holding and feeding device 20 will be explained in detail with reference to FIGS. 16 to 18.

The lifting mechanism 24 has the function of moving the frame 23 upward and downward. In other words, the lifting mechanism 24 has the function of moving upward and downward the eight tables 162A to 162H included in the table set 22 collectively. Furthermore, the lifting mechanism 24 has the function of moving a desired one of the tables 162A to 162H (in other words, a target table) backward to a predetermined card conveying position, where a card C supplied from the card supplying device 10 is placed on the desired one of the tables 162A to 162H (i.e., the target table) and the card C thus placed on the target table is fed forward in the card feeding direction CD using the card conveying device 28.

Figure 16:
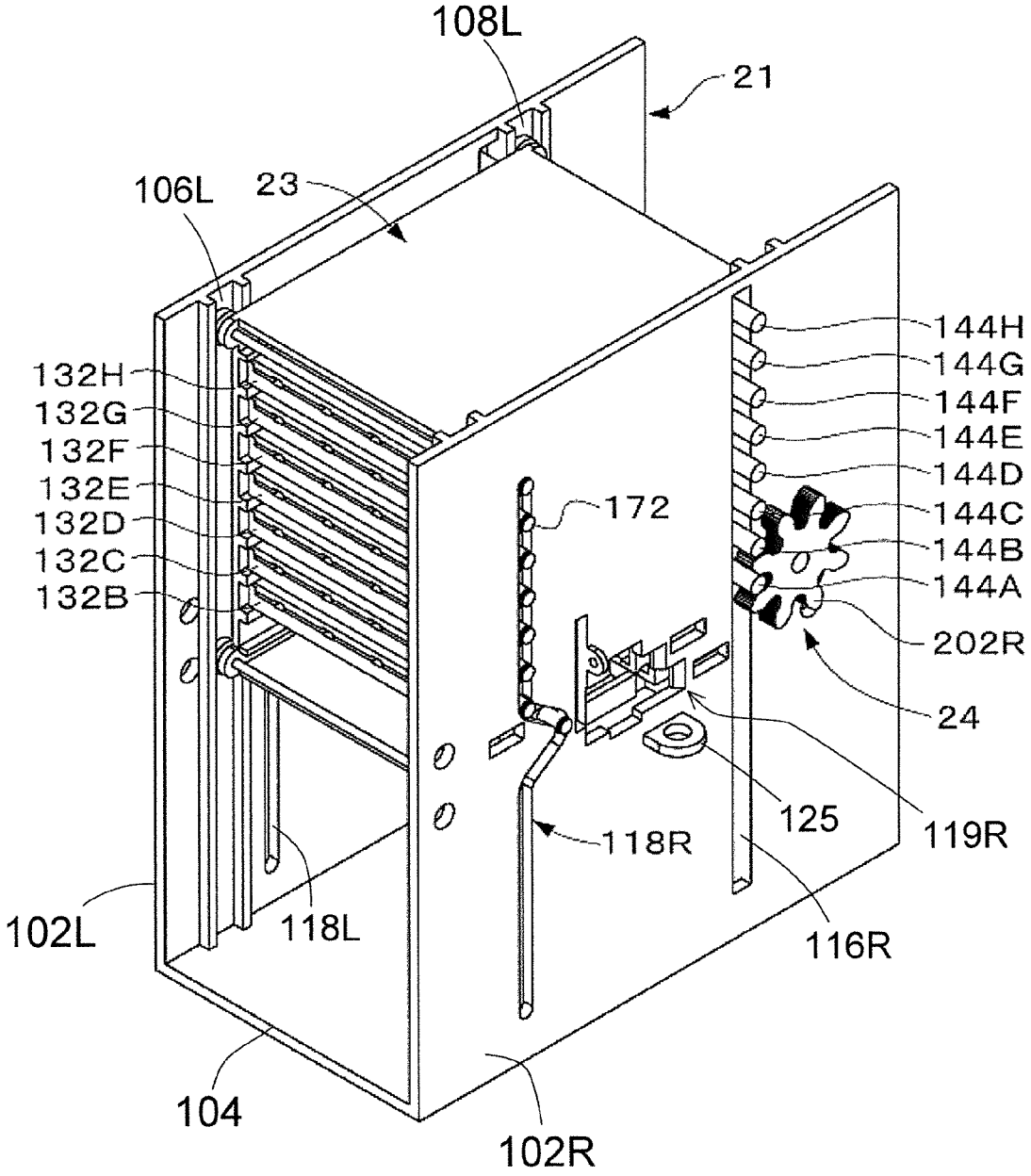
FIG. 16 is a perspective view showing the main part of the card holding and feeding device of FIG. 3, where the card conveying device and the driving devices are omitted.

The lifting mechanism 24 comprises the eight driven pins 144A to 144H provided on the frame 23, and a pair of lifting gears 202R and 202L designed to be selectively meshed with the driven pins 144A to 144H, as shown in FIG. 16. The driven pins 144A to 144H have the same length and the same diameter D1 and are arranged vertically at a pitch H1. The lift gears 202R and 202L, which are spur gears with eight teeth, are rotatably supported by a common support shaft 204 and are respectively placed outside the right and left sidewalls 102R and 102L of the body 21. The tooth pitches and tooth widths of the lifting gears 202R and 202L are the same and are determined in accordance with the diameter D1 and the pitch H1 of the driven pins 144A to 144H.

The lifting mechanism 24 is designed to operate as follows. Specifically, each of the lowest-positioned table 162A to the highest-positioned table 162H is successively located at the same card conveying position by a single rotation of the lifting gears 202R and 202L. When the lifting gears 202R and 202L are rotated counterclockwise in FIG. 16, the frame 23 (i.e., the table set 22) is lowered. When the lifting gears 202R and 202L are rotated clockwise in FIG. 16, the frame 23 (i.e., the table set 22) is raised. Therefore, according to the rotation angles of the lifting gears 202R and 202L, a desired one of the tables 162A to 162H (i.e., a target table) can be moved to the card conveying position.

FIGS. 14 to 16 show the state where the lowest-positioned table 162A is located at the card conveying position where a card C supplied from the card supplying device 10 is placed on a desired one of the tables 162A to 162H (i.e., a target table) and the card C thus placed is fed forward therefrom. In this state, the table 162A has been horizontally slid backward at a the predetermined distance with respect to the remaining tables 162B to 162H by the aforementioned sliding mechanism (i.e., the combination of the guide pins 172 and 174, the guide holes 142R and 142L, and the cam holes 118R and 118L).

Conveying Mechanisms

Next, the card conveying device 28 of the card holding and feeding device 20 will be explained in detail with reference to FIGS. 19, 20A, 20B, 21A and 21B.

The card conveying device 28 has the function of conveying a card C supplied from the card supplying device 10 to a desired one of the tables 162A to 162H (i.e., a target table) and the function of conveying the card C placed and held on the desired one of the tables 162A to 162H (i.e., the target table) forward in the card feeding direction CD. The card conveying (i.e., a target table) device 28 comprises the first roller unit 25 placed behind the tables 162A to 162H (i.e., the frame 23), the second roller unit 26 placed at the right and left sides of the tables 162A to 162H, and the third roller unit 27 placed ahead of the tables 162A to 162H. The second roller unit 26 is located between the first roller unit and the third roller unit 27 along the card feeding direction CD. In FIGS. 20A, 20B, 21A and 21B, the state where the lowest-positioned table 162A is located at the card conveying position is shown.

The first roller unit 25 has the following structure and function.

Specifically, the first roller unit 25 comprises a pair of rollers 214 and a pair of rollers 218. The pair of rollers 214 is fixed to a support shaft 212 which extends horizontally along an axis perpendicular to the card conveying direction CD so as to be spaced at a predetermined interval. Similarly, the pair of rollers 218 is fixed to a support shaft 216 which extends parallel to the support shaft 212 and which is placed below the same so as to be spaced at the same interval as the pair of rollers 214. The support shafts 212 and 216 are rotatably supported by the body 21. The pair of rollers 214 and 218 are in contact with each other. Gears 222 and 224 are respectively fixed to the right ends of the support shafts 212 and 216 so as to be meshed with each other. Due to this structure, the pair of the rollers 214 and the pair of rollers 218 are rotated in opposite directions; specifically, the pair of rollers 214 is rotated clockwise and the pair of rollers 218 is rotated counterclockwise in FIG. 19. Accordingly, by the operation of the pairs of rollers 214 and 218, a card C supplied from the card supplying device 10 can be conveyed to the table 162A (i.e., the target table) and placed thereon.

The second roller unit 26 comprises a right roller subunit 230R and a left roller subunit 230L, both of which form a symmetric structure. Thus, the explanation about the left roller subunit 230L is omitted here and the explanation about the right roller subunit 230R will be presented below.

The right roller subunit 230R comprises a roller 232 and a gear 238, both of which are fixed to a support shaft 234. The gear 238, which is located below the roller 232, is rotated along with the roller 232 as the support shaft 234 is rotated. The right roller subunit 230R further comprises a gear 240 which is provided adjacent to the gear 238 and meshed therewith. The support shafts 234 and 236 are fixed to a lever 237 which is provided below them. As shown in FIGS. 3 and 6, the support shaft 236 is rotatably supported by a shaft support member 125 formed on the outer surface of the right sidewall 102R of the body 21. The shaft support member 125 is formed to protrude laterally from the outer surface of the right sidewall 102R at a position just below the roller device receiving aperture 119R. The shaft support member 125 receives rotatably the lower end of the support shaft 236.

Since the left roller subunit 230L and the right roller subunit 230R form a symmetric structure with respect to the central axis of the table set 22 along the card feeding direction CD, the left roller subunit 230L operates symmetrically with the right roller subunit 230R.

Figure 19:
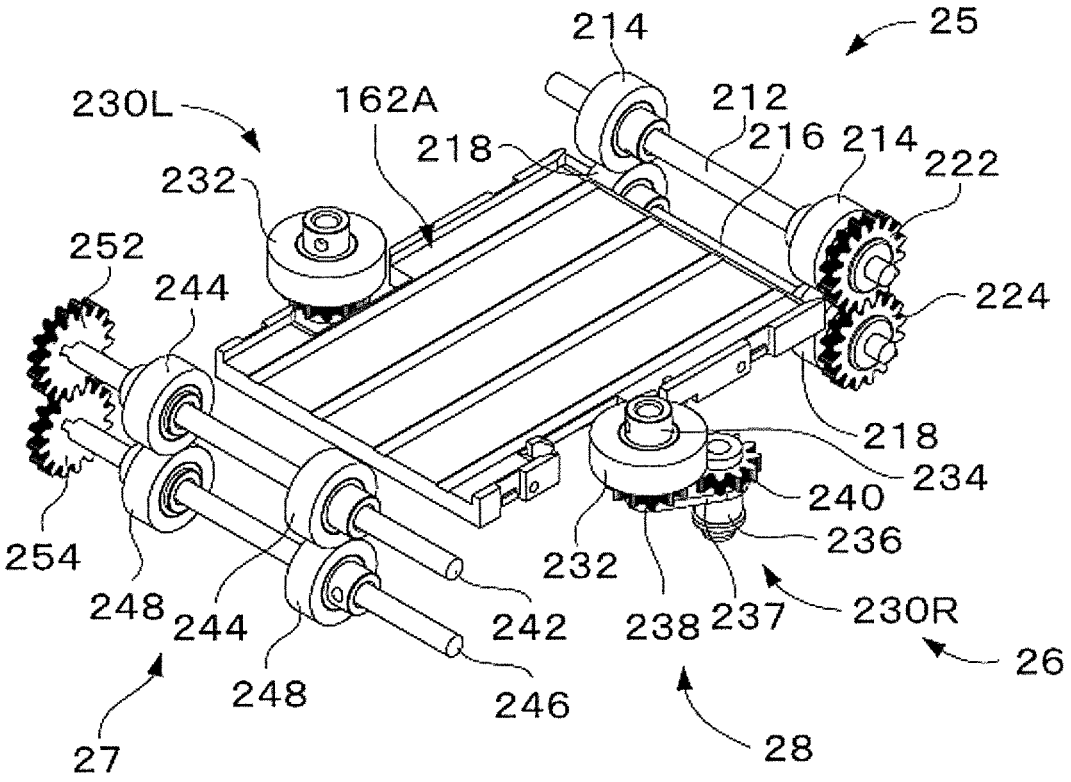
FIG. 19 is a perspective view showing the card conveying device that constitutes a part of the card holding and feeding device of FIG. 3.
Figure 20A:
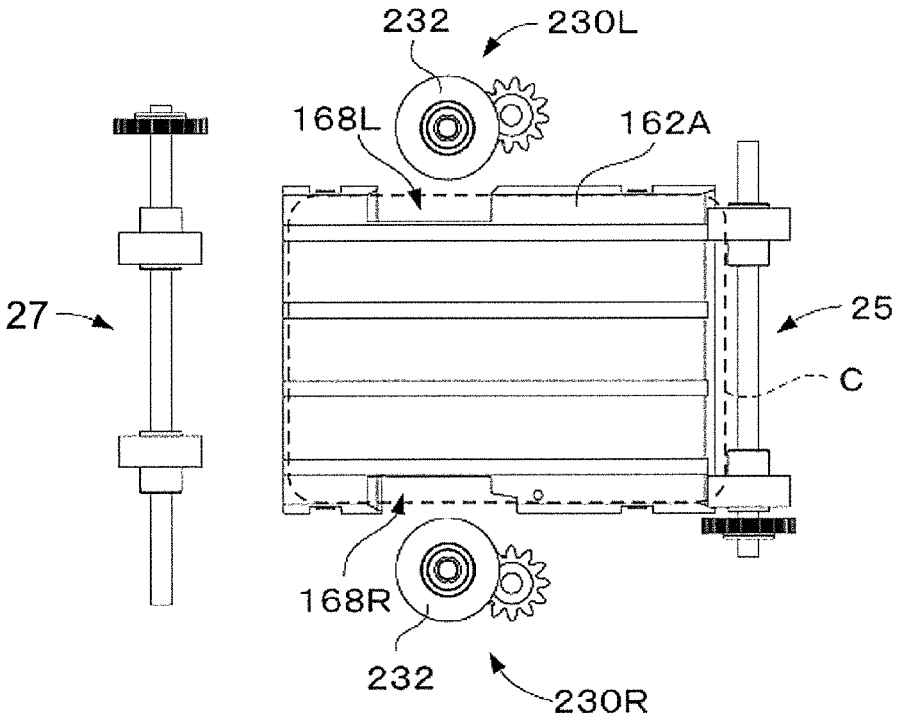
FIG. 20A is a plan view showing the card conveying device of FIG. 19, where the state before a card is conveyed is shown.
Figure 20B:
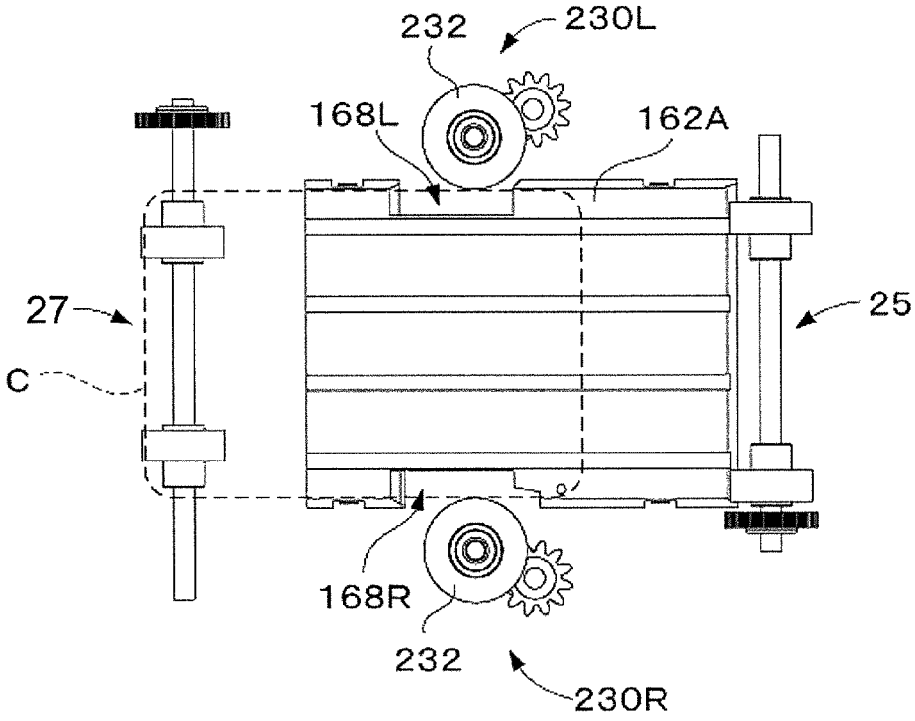
FIG. 20B is a plan view showing the card conveying device of FIG. 19, where a card is being conveyed forward.

If the support shaft 236 of the right roller subunit 230R is rotated clockwise and the support shaft 236 of the left roller subunit 230L is rotated counterclockwise in FIG. 19, the roller 232 is rotated counterclockwise due to the mesh of the gears 238 and 240, and the lever 237 is rocked counterclockwise in the right roller subunit 230R, and at the same time, the roller 232 is rotated clockwise due to the mesh of the gears 238 and 240 and the lever 237 is rocked clockwise in the left roller subunit 230L. Because of such the rocking motions of the levers 237 in the right and left roller subunits 230R and 230L, as shown in FIG. 20B, a part of the right-side roller 232 enters the inside of the cutout portions 168R of the table 162A and at the same time, a part of the left-side roller 232 enters the inside of the cutout portion 168L of the table 162A. In this way, the two rollers 232 in the right and left roller subunits 230R and 230L are contacted with two opposing side edges of a card C which has been placed on the table 162A by the first roller unit 25. If the right-side roller 232 in the right roller subunit 230R is rotated counterclockwise and the left-side roller 232 in the left roller subunit 230L is rotated clockwise in this contact state, the card C is sent forward to the third roller unit 27 due to the rotations of the rollers 232.

On the other hand, if the support shaft 236 of the right roller subunit 230R is rotated counterclockwise and the support shaft 236 of the left roller subunit 230L is rotated clockwise in FIG. 19, the lever 237 in the right roller subunit 230R is rocked counterclockwise and the lever 237 in the left roller subunit 230L is rocked clockwise. Accordingly, because of the aforementioned rocking motions of the levers 237 in the right and left roller subunits 230R and 230L, as shown in FIG. 20A, the two rollers 232 in the roller subunits 230R and 230L exit from the insides of the cutout portions 168R and 168L of the table 162A, respectively. In this way, the rollers 232 in the roller subunits 230R and 230L are detached from the opposing side edges of the card C placed on the table 162A, resulting in the non-contact state. The upward or downward motion of the frame 23 by the lifting mechanism 24 is carried out in this non-contact state.

In this embodiment, since the second roller unit 26 is structured such that the upward and downward motion of the frame 23 by the lifting mechanism 24 is carried out in this non-contact state, there is an additional advantage that the card C held on the designated table (i.e., the target table) can be fed more surely and that the danger of hindering the vertical movement of the frame 23 can be eliminated.

The third roller unit 27 have approximately the same structure and function as the first roller unit 25. Specifically, the third roller unit 27 comprises a pair of rollers 244 and a pair of rollers 248. The pair of rollers 244 is fixed to a support shaft 242 extending horizontally along an axis perpendicular to the card feeding direction CD so as to be spaced at a predetermined interval. Similarly, the pair of rollers 248 is fixed to a support shaft 246 extending parallel to the support shaft 242 and placed below the same so as to be spaced at the same interval as the pair of rollers 244. The support shafts 242 and 246 are rotatably supported. The pair of rollers 244 and 248 are in contact with each other. Gears 252 and 254 are respectively fixed to the left ends of the support shafts 242 and 246 so as to be meshed with each other. Due to this structure, the pair of the rollers 244 and the pair of rollers 248 are rotated in opposite directions; specifically, the pair of rollers 244 is rotated clockwise and the pair of rollers 248 is rotated counterclockwise in FIG. 19. Accordingly, by the operations of the pairs of rollers 244 and 248, the card C which has been conveyed so far by the second roller unit 26 is further sent forward in the card feeding direction CD toward the outside of the card feeding apparatus 1 of this embodiment.

In this embodiment, since the conveying operation of a card C is divided into three parts and assigned respectively these three parts to the first to third roller units 25, 26, and 27. Thus, there is an additional advantage that the complicated conveying operation of a card C can be realized with a comparative simple structure.

Card Sensor Device

Following this, the card sensor device 30 of the card holding and feeding device 20 will be explained in detail with reference to FIG. 6 and FIGS. 21A and 21B.

The card sensor device 30 is provided on the body 21 for each of the tables 162A to 162H. The card sensor device 30 has the function of sensing whether or not a card C is placed on a corresponding one of the tables 162A to 162H. Here, the case where a card C is placed on the table 162A will be explained as an example.

Figure 21A:
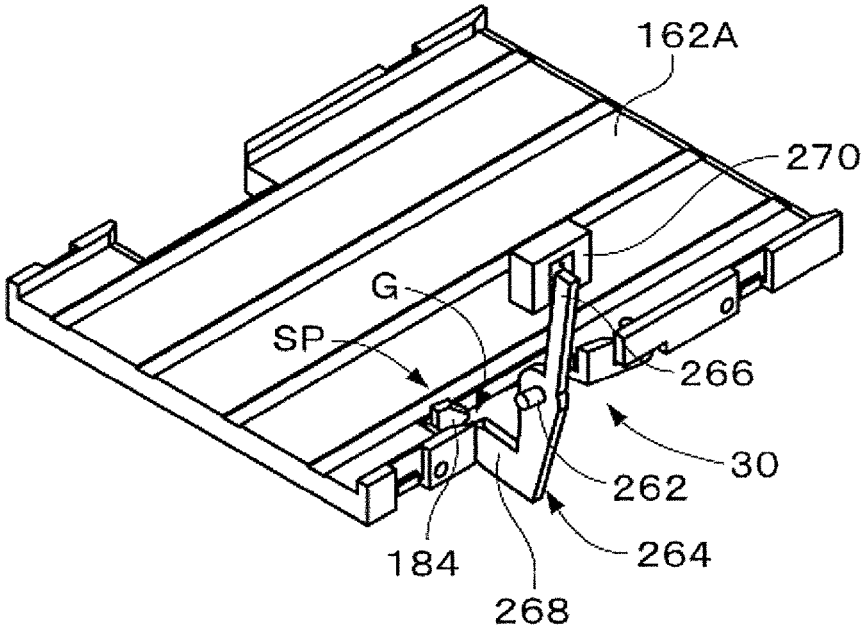
FIG. 21A is a perspective view showing the card sensor device that constitutes a part of the card holding and feeding device of FIG. 3, where a card is not placed on the table.
Figure 21B:
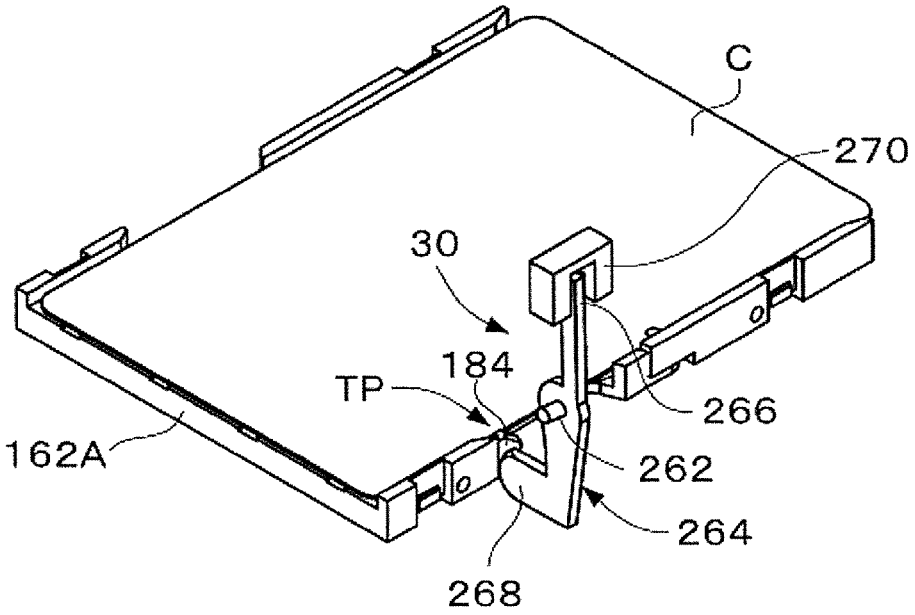
FIG. 21B is a perspective view showing the card sensor device that constitutes a part of the card holding and feeding device of FIG. 3, where a card is placed on the table.
Figure 22:
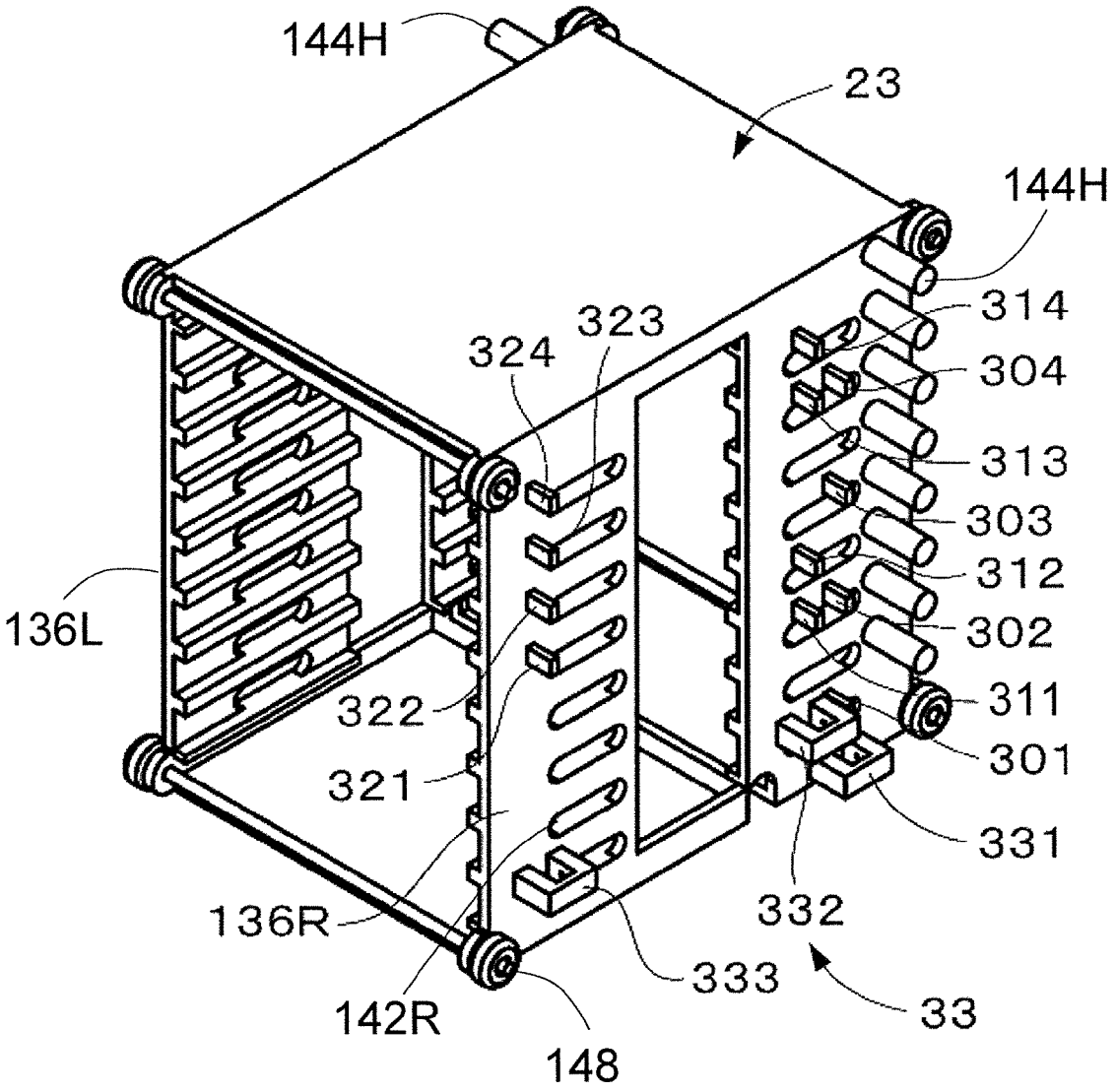
FIG. 22 is a perspective view showing the frame position sensor device that constitutes a part of the card holding and feeding device of FIG. 3.

As shown in FIG. 21A, the card sensor device 30 comprises a lever 264 fixed to a support shaft 262, and a photoelectric sensor 270 for sensing the motion or position of the lever 264. The support shaft 262 is rockably supported by a shaft supporter 126 formed on the body 21, as shown in FIG. 6. The shaft supporter 126 protrudes laterally from the outer surface of the right sidewall 102R of the body 21 and thus, the support shaft 262 is rockable around the shaft supporter 126 in a horizontal plane. The lever 264, which has an approximately L-shaped contour, includes a lower part which is placed to be lower than the support shaft 262 and an upper part which is placed to be higher than the support shaft 262. A first operating end 268, which is formed at the end of the lower part of the lever 264, is located near the table 162A to be opposite to the protrusion 184 of the rocking lever 178 on the table 162A. A gap G is formed between the first operating end 268 and the protrusion 184. A second operating end 266, which is formed at the top of the upper part of the lever 264, is located near the corresponding photoelectric sensor 270 provided for the table 162A. The lever 264 is biased or urged with a biasing or urging member (not shown) clockwise in FIG. 21A.

The photoelectric sensor 270 is a transmission-type sensor having an inverted U-shaped contour. The sensor 270 comprises a light emission part formed at its one end and a light reception part formed at the other end. The sensor 270 is fixed to the outer surface of the right sidewall 102R of the body 21 in such a way that the light beam emitted from the light emission part is kept in a horizontal direction. The second operating end 266 of the lever 264 is designed in such a way as to insert into the space between the light emission part and the light reception part of the sensor 270 and to exit from the said space in accordance with the rocking motion of the lever 264. This means that the output signal of the sensor 270 is changed responsive to whether or not the second operating end 266 of the lever 264 blocks the light beam emitted from the light emission part (i.e., intercepts the optical path of the light beam).

As shown in FIG. 21A, in the case where a card C is not held on the table 162A, the protrusion 184 of the rocking lever 178 of the table 162A is located at the standby position SP, as explained above; as a result, the first operating end 268 of the lever 264 is apart from the protrusion 184 of the table 162A. For this reason, the second operating end 266 of the lever 264 does not block the light beam emitted from the sensor 270, which keeps the output signal of the sensor 270 at a predetermined high (H) level. In the case where a card C is held on the table 162A, the protrusion 184 of the rocking lever 178 of the table 162A is shifted to the protruded position TP, as explained above; as a result, the first operating end 268 of the lever 264 is pressed by the protrusion 184 of the table 162A. For this reason, the lever 264 is rocked counterclockwise against the biasing/urging force of the biasing/urging member, and the second operating end 266 of the lever 264 blocks the light beam emitted from the sensor 270, which changes the output signal of the sensor 270 to a predetermined low (L) level from the H level. In this way, whether or not a card C is held on the table 162A can be detected with the output signal of the photoelectric sensor 270.

Needless to say, the aforementioned explanation for the table 162A is applicable to any of the remaining tables 162B to 162H.

First and Second Driving Devices

Next, the first and second driving devices 31 and 32 of the card holding and feeding device 20 will be explained in detail with reference to FIGS. 3 to 5.

The first driving device 31, which is placed behind the cam holes 118R and 118L of the body 21, has the function of driving the lifting mechanism 24 by way of driving the pair of lifting gears 202R and 202L.

Figure 3:
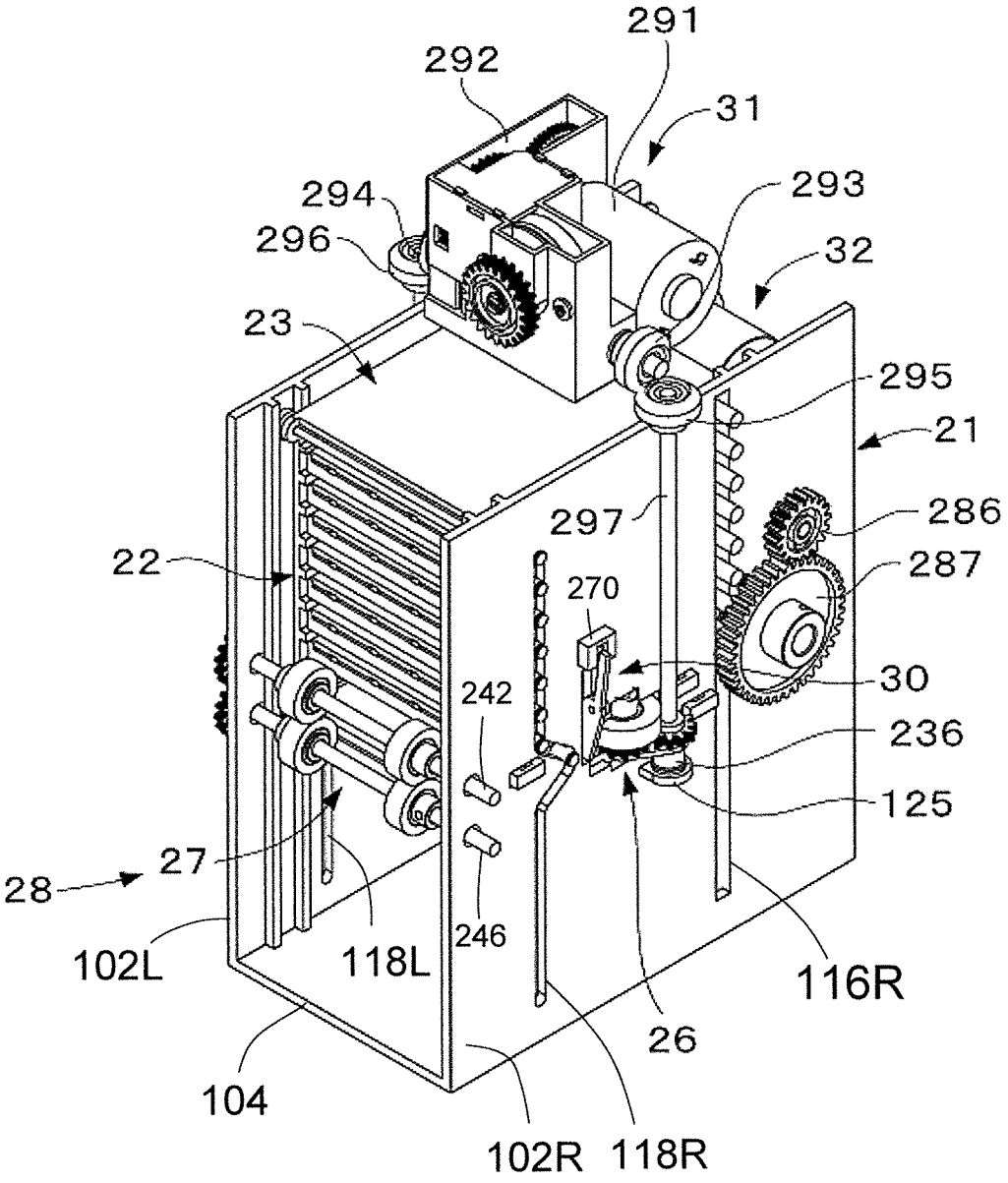
FIG. 3 is a perspective view showing the card holding and feeding device that constitutes a part of the card feeding apparatus of FIG. 1, which is seen from the front in an obliquely upward direction.
Figure 4:
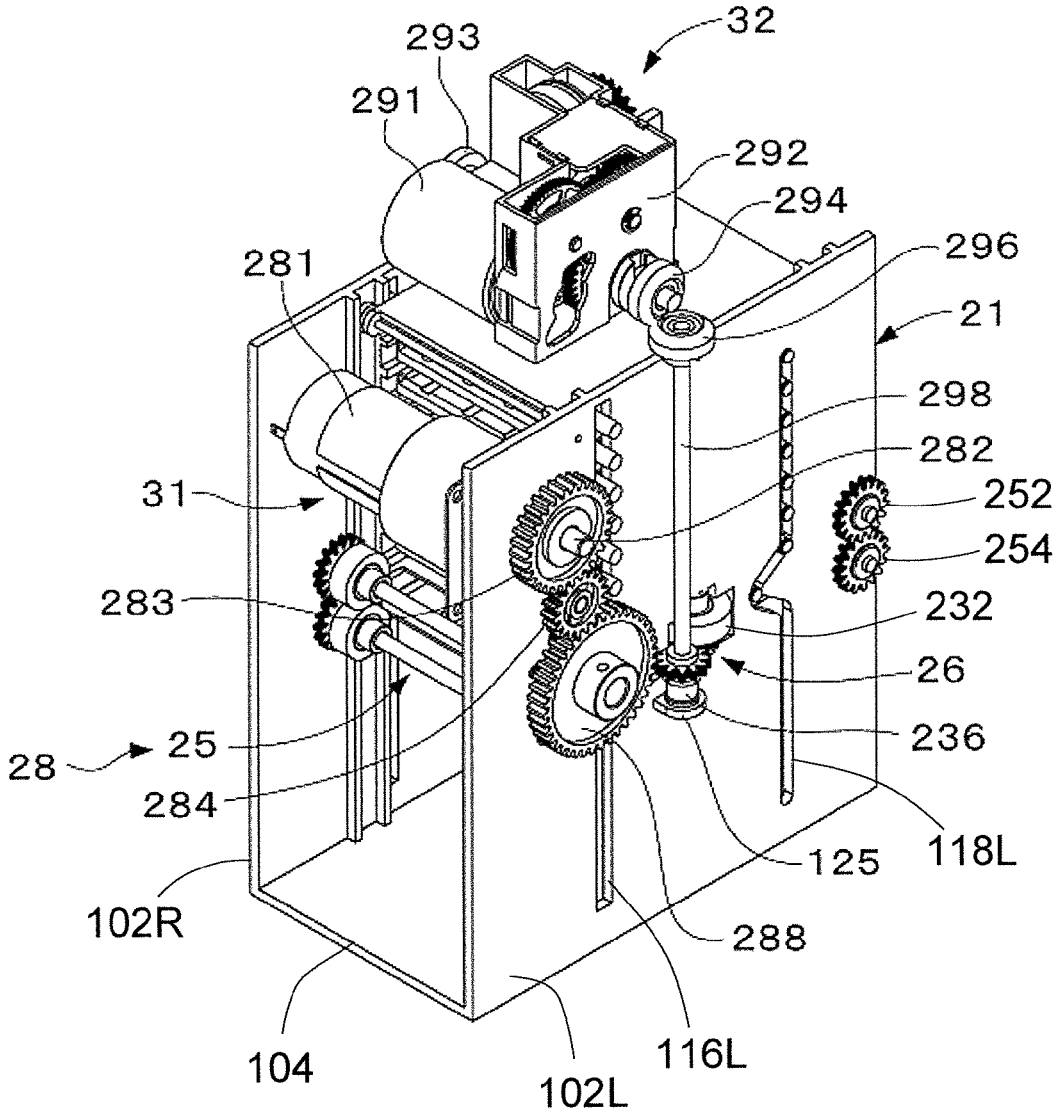
FIG. 4 is a perspective view showing the card holding and feeding device of FIG. 3, which is seen from the back in an obliquely upward direction.
Figure 5:
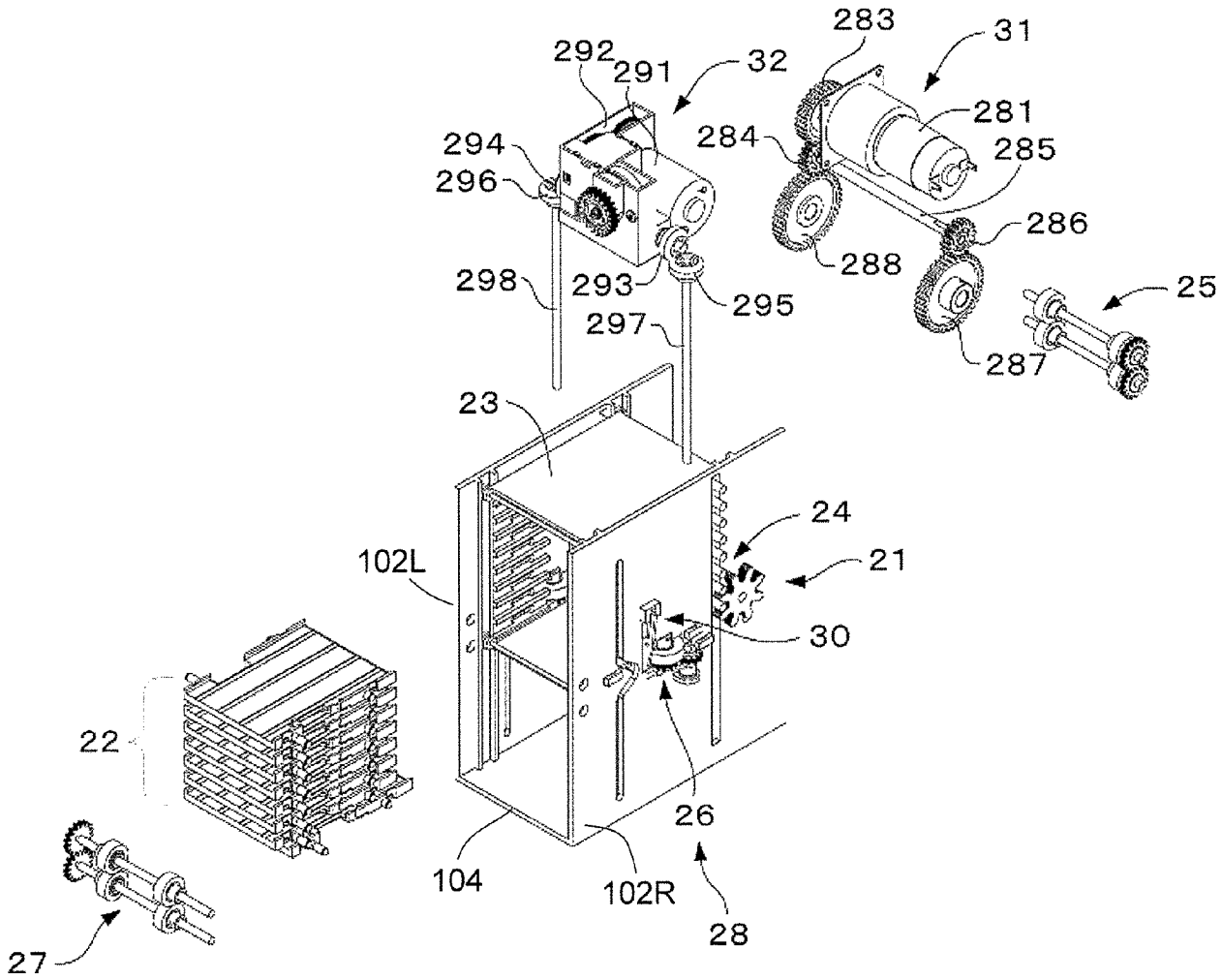
FIG. 5 is an exploded perspective view showing the main part of the card holding and feeding device of FIG. 3.

The first driving device 31 comprises a first electric motor 281, a gear 283 coaxially connected to the output shaft 282 of the first motor 281, a gear 284 meshed with the gear 283, a gear 286 connected to the gear 284 by way of a shaft 285, a gear 287 meshed with the gear 286, and a gear 288 meshed with the gear 284, as shown in FIGS. 3 to 5. The output shaft 282 and the shaft 285 extend horizontally. The first motor 281 is placed in the body 21. The gears 283, 284, and 288 are placed outside the body 21 to be adjacent to the left sidewall 102L. The gears 286 and 287 are placed outside the body 21 to be adjacent to the right sidewall 102R. Almost all the shaft 285 is placed in the body 21. The right-side lifting gear 202R is placed coaxially with the gear 287 and the left-side lifting gear 202L is placed coaxially with the gear 288.

The combination of the gears 283, 286, and 287 serves as a reduction gear set for the right-side lifting gear 202R provided near the right sidewall 102R. The combination of the gears 283, 284, and 288 serves as a reduction gear set for the left-side lifting gear 202L provided near the left sidewall 102L. The driving force from the first electric motor 281 is transmitted to the right-side lifting gear 202R by way of the gears 283, 286, and 287 and at the same time, transmitted to the left-side lifting gear 202L by way of the gears 283, 284, and 288. By the rotations of the two lifting gears 202R and 202L, the lifting mechanism 24 is moved vertically upward and downward.

The second driving device 32, almost all of which is placed above the roller device receiving apertures 119R and 119L of the body 21, has the function of driving the first, second, and third roller units 25, 26, and 27 of the card conveying device 28

The second driving device 32 comprises a second electric motor 291, a reduction gear mechanism 292 connected to the output shaft (not shown) of the second motor 291, bevel gears 293 and 294 fixed coaxially with the output shaft (not shown) of the reduction gear mechanism 292, bevel gears 295 and 296 meshed respectively with the bevel gears 293 and 294, shafts 297 and 298 respectively fixed coaxially with the bevel gears 295 and 296, and connection mechanisms (not shown) which are connected to the reduction gear mechanism 292 and which are connected respectively to the first and third roller units 25 and 27. The shaft 297 is connected to the support shaft 236 of the right roller subunits 230R. The shaft 298 is connected to the support shaft 236 of the left roller subunits 230L.

The second motor 291, the reduction gear mechanism 292, and the bevel gears 293, 294, 295, and 296 are placed on the top of the body 21. The shafts 297 and 298 are placed outside the body 21 in such a way as to be respectively extending vertically along the right and left sidewalls 102R and 102L.

The driving force of the second electric motor 291 is transmitted to the second roller device 26 by way of the reduction mechanism 292, the bevel gears 293, 294, 295, and 296, and the shafts 297 and 298. At the same time, the driving force of the second motor 291 is transmitted to the first and third roller units 25 and 27 by way of the reduction mechanism 292 and the non-illustrated connection mechanisms.

Frame Position Sensor Device

Next, the frame position sensor device 33 of the card holding and feeding device 20 will be explained in detail with reference to FIGS. 22 to 25.

The frame position sensor device 33 has the function of sensing the vertical position of the frame 23 while the frame 23 is moved upward or downward using the lifting mechanism 24. This means that the device 33 detects which one of the tables 162A to 162H is located at the card conveying position.

The frame position sensor device 33 comprises the twelve operating protrusions 301 to 304, 311 to 314, and 321 to 324 formed on the outer surface of the right side plate 136R of the frame 23, and three photoelectric sensors 331, 332, and 333 mounted on the inner surface 110R of the right side plate 116R of the body 21. Each of the operating protrusions 301 to 304, 311 to 314, and 321 to 324 has a shape of elongated rectangular parallelepiped and is located at a predetermined position on the right side plate 136R. Each of the photoelectric sensors 331, 332, and 333 is a transmission-type sensor having an inverted U-shaped contour, and comprises a light emission part formed at its one end and a light reception part formed at the other end.

The photoelectric sensor 331 is fixed to the inner surface 110R of the right sidewall 102R of the body 21 in such a way that the light beam emitted from the light emission part is kept in a horizontal direction. The operating protrusions 301 to 304 are designed in such a way as to vertically pass through the space between the light emission part and the light reception part of the sensor 331. This means that the sensor 331 can detect whether or not the light beam emitted from the light emission part is blocked by any one of the protrusions 301 to 304.

Similarly, the photoelectric sensor 332 is fixed to the inner surface 110R of the right sidewall 102R of the body 21 in such a way that the light beam emitted from the light emission part is kept in a horizontal direction. The operating protrusions 311 to 314 are designed in such a way as to vertically pass through the space between the light emission part and the light reception part of the sensor 332. This means that the sensor 332 can detect whether or not the light beam emitted from the light emission part is blocked by any one of the protrusions 311 to 314.

The photoelectric sensor 333 is fixed to the inner surface 110R of the right sidewall 102R of the body 21 in such a way that the light beam emitted from the light emission part is kept in a horizontal direction. The operating protrusions 321 to 324 are designed in such a way as to vertically pass through the space between the light emission part and the light reception part of the sensor 333. This means that the sensor 333 can detect whether or not the light beam emitted from the light emission part is blocked by any one of the protrusions 321 to 324.

Figure 23:
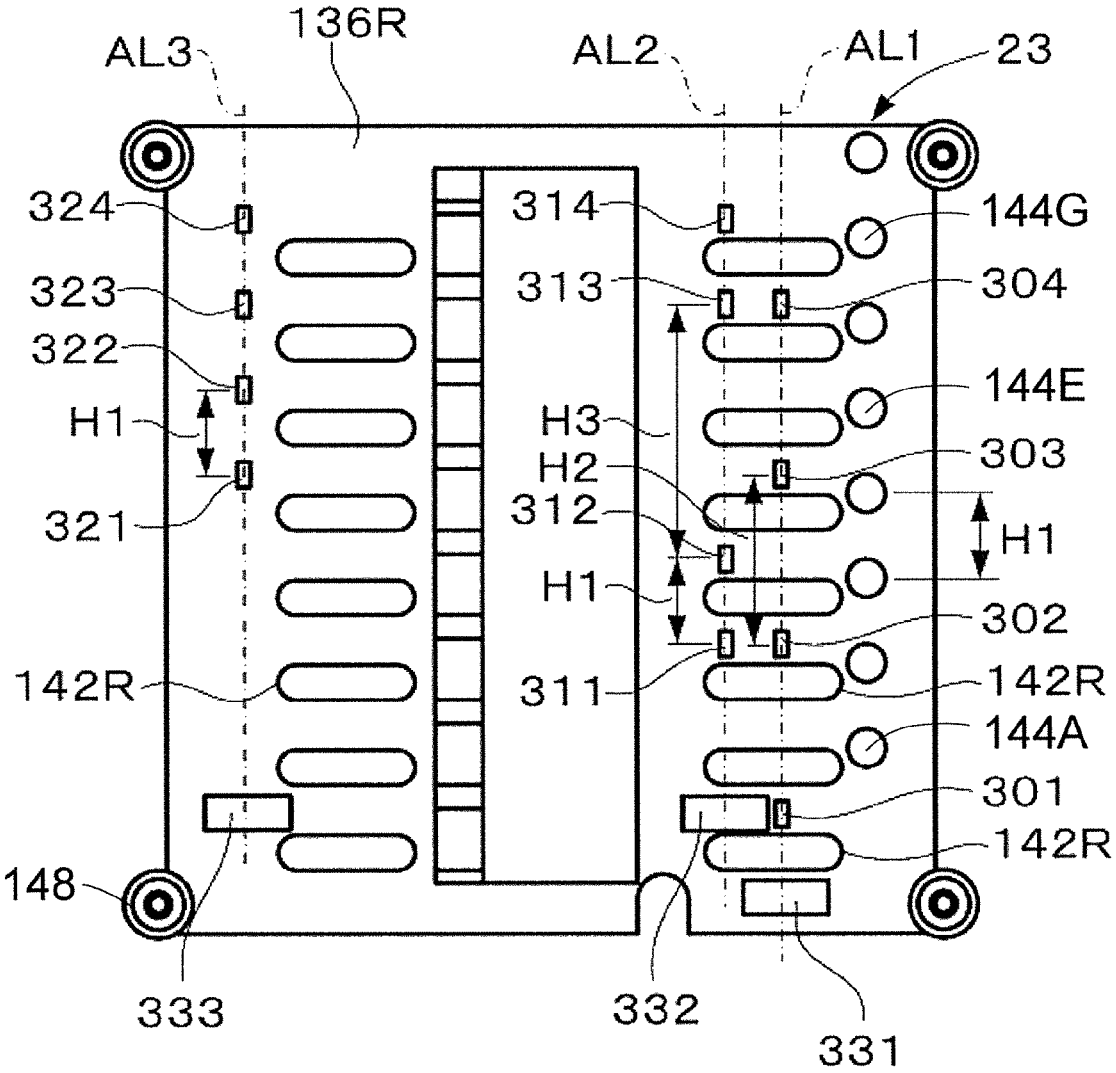
FIG. 23 is a right side view showing the frame position sensor device of FIG. 22, where the frame is located at the highest position.

As shown in FIG. 23, the operating protrusions 301 to 304 are arranged at a predetermined pitch H2 on the first arrangement line AL1 extending vertically, where the pitch H2 is twice as much as the pitch H1 of the driven pins 144A to 144H. The protrusion 301 is placed corresponding to the driven pin 144A, the protrusion 302 is placed corresponding to the driven pin 144C, the protrusion 303 is placed corresponding to the driven pin 144E, and the protrusion 304 is placed corresponding to the driven pin 144G. The photoelectric sensor 331 is also located on the first arrangement line AL1.

The operating protrusions 311 to 314 are arranged on the second arrangement line AL2 extending parallel to the first arrangement line AL1 The interval (pitch) between the protrusions 311 and 312 and that between the protrusions 313 and 314 are equal to the pitch H1 of the driven pins 144A to 144H. The interval (pitch) between the protrusions 312 and 313 is H3 which is three times as much as the pitch H1 of the driven pins 144A to 144H. The protrusion 311 is laterally adjacent to the protrusion 302, and the protrusion 313 is laterally adjacent to the protrusion 304. The protrusion 311 is placed corresponding to the driven pin 144C, the protrusion 312 is placed corresponding to the driven pin 144D, the protrusion 313 is placed corresponding to the driven pin 144G, and the protrusion 314 is placed corresponding to the driven pin 144H. The photoelectric sensor 332 is also located on the second arrangement line AL2.

The operating protrusions 321 to 324 are arranged on the third arrangement line AL3 extending parallel to the first and second arrangement lines AL1 and AL2 at the pitch H1. The protrusion 321 is placed corresponding to the driven pin 144E, the protrusion 322 is placed corresponding to the driven pin 144F, the protrusion 323 is placed corresponding to the driven pin 144G, and the protrusion 324 is placed corresponding to the driven pin 144H. The photoelectric sensor 333 is also located on the third arrangement line AL3.

The photoelectric sensor 331 has the function of sensing the operating protrusions 301 to 304 which are moved in accordance with the up-and-down movement of the frame 23. When any one of the operating protrusions 301 to 304 is positioned on the optical path of the sensing light beam from the sensor 331, in other words, any one of the protrusions 301 to 304 blocks the light beam from the sensor 331, the output signal of the sensor 331 is changed.

The photoelectric sensor 332 has the function of sensing the operating protrusions 311 to 314 which are moved in accordance with the up-and-down movement of the frame 23. When any one of the operating protrusions 311 to 314 is positioned on the optical path of the sensing light beam from the sensor 332, in other words, any one of the protrusions 311 to 314 blocks the light beam from the sensor 332, the output signal of the sensor 332 is changed.

The photoelectric sensor 333 has the function of sensing the operating protrusions 321 to 324 which are moved in accordance with the up-and-down movement of the frame 23. When any one of the operating protrusions 321 to 324 is positioned on the optical path of the sensing light beam from the sensor 333, in other words, any one of the protrusions 321 to 324 blocks the light beam from the sensor 333, the output signal of the sensor 333 is changed.

Based on the combination of the output signals of the three photoelectric sensors 331, 332, and 333, the position of the vertically moving frame 23 can be detected. For example, in the case of FIG. 23 where the frame 23 is located at its highest position, the driven pin 144A placed at the lowest position is engaged with or supported by the lifting gears 202R and 202L, as shown in FIG. 17. In this state, none of the sensors 331, 332, and 333 detect the operating protrusions 301 to 304, 311 to 314, and 321 to 324 and as a result, all the output signals of the sensors 331, 332, and 333 are in the level L.

Figure 24:
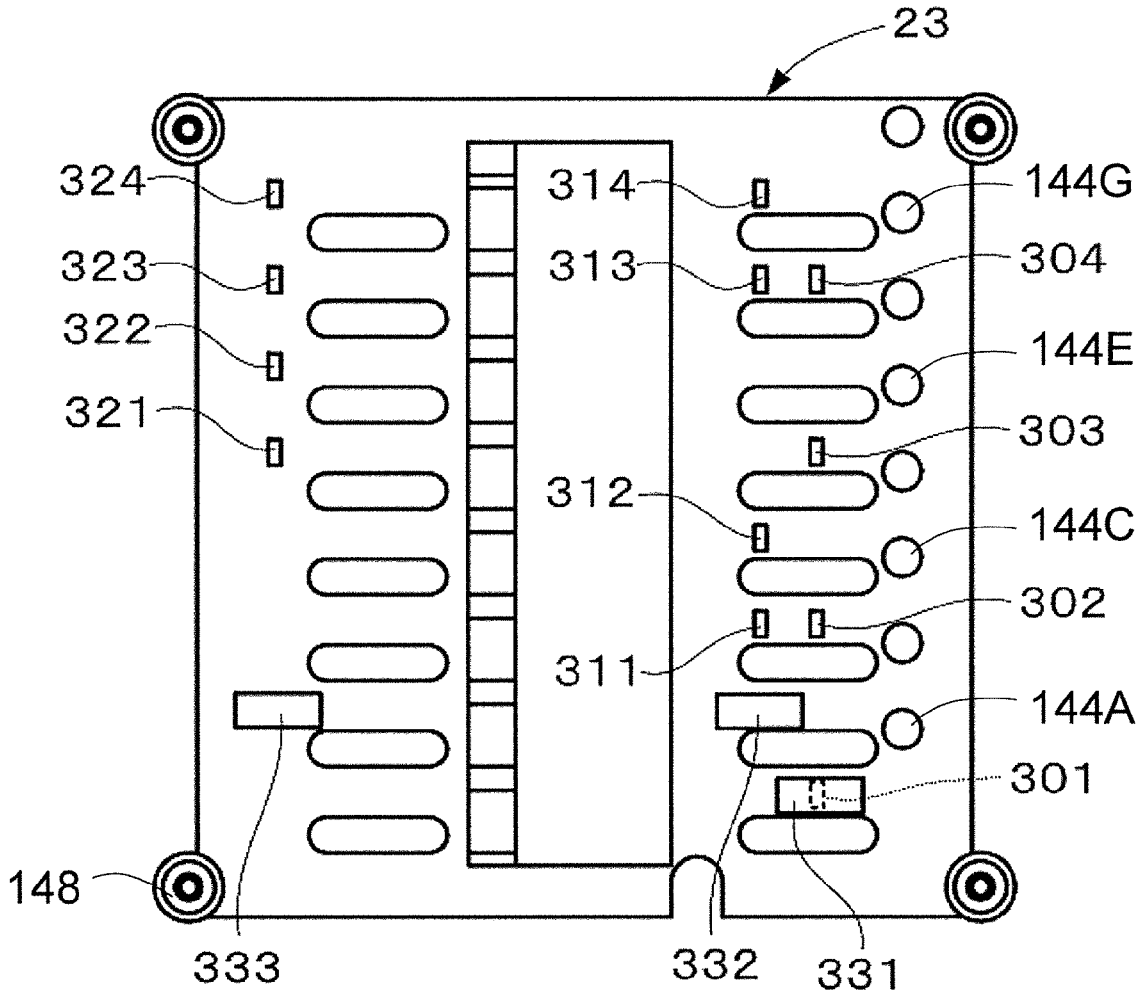
FIG. 24 is a right side view showing the frame position sensor device of FIG. 22, where the frame is located at the second highest position.

FIG. 24 shows the case where the frame 23 is located at its second highest position. In this case, the driven pin 144B placed at the second lowest position is engaged with or supported by the lifting gears 202R and 202L. In this state, only the sensor 331 detects the protrusion 301 and the other two sensors 332 and 333 do not detect the protrusions 311 to 314 and 321 to 324. As a result, only the output signal of the sensor 331 is turned to the level H and the output signals of the remaining sensors 332 and 333 are kept in the level L.

Figure 25:
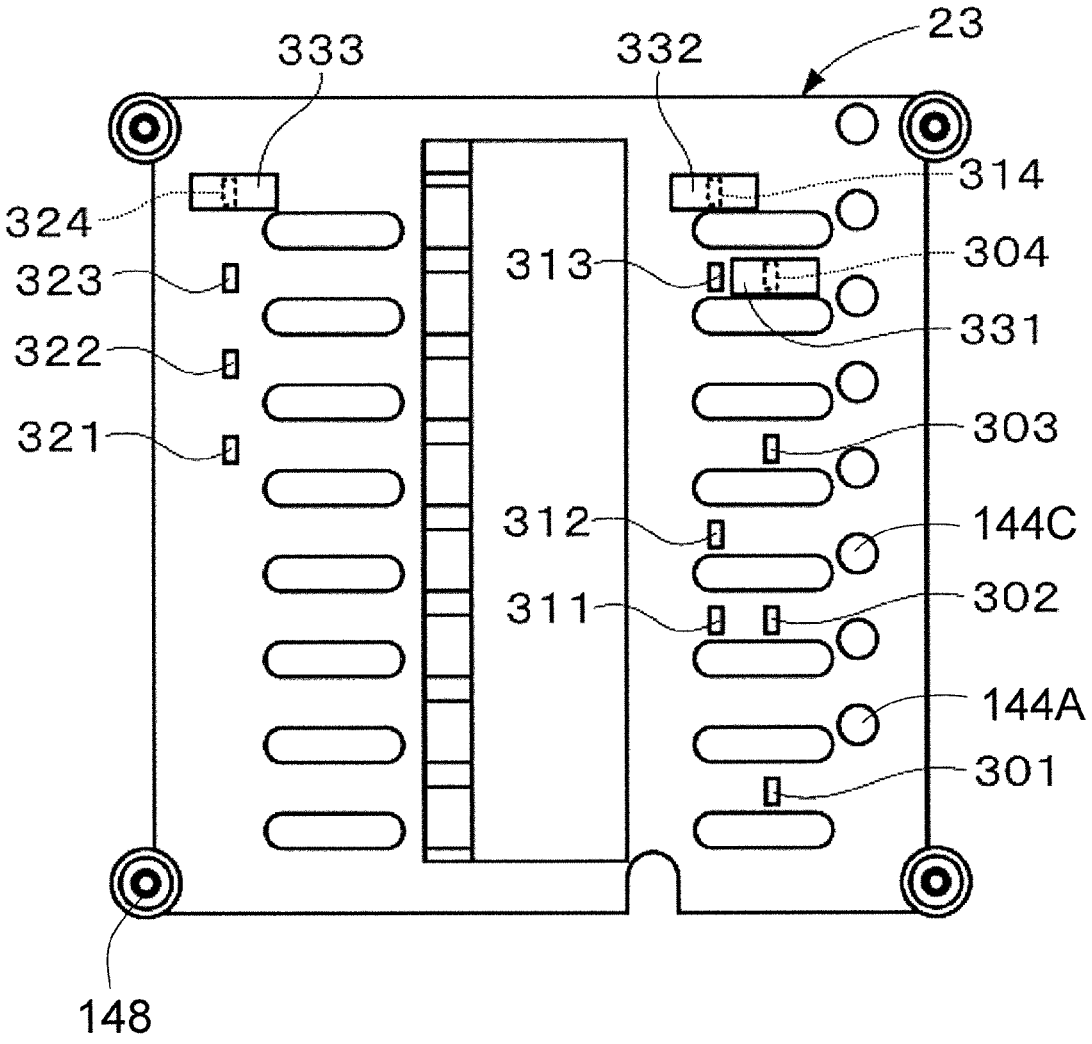
FIG. 25 is a right side view showing the frame position sensor device of FIG. 22, where the frame is located at the lowest position.

FIG. 25 shows the case where the frame 23 is located at its lowest position. In this case, the driven pin 144H placed at the highest position is engaged with or supported by the lifting gears 202R and 202L. In this state, the three sensors 331, 332, and 333 detect the protrusion 304, 314, and 324, respectively. As a result, all the output signals of the sensors 331, 332, and 333 are turned to the level H.

The relationship between the supporting or engaging state of the driven pins 144A to 144H (i.e., which one of the driven pins 144A to 144H is supported by or engaged with the lifting gears 202R and 202L) and the output signal level (L or H) of the sensors 331, 332, and 333 is shown in the Table 1 below.

TABLE 1

| Driven Pin | Sensor 331 | Sensor 332 | Sensor 333 |
|---|---|---|---|
| 144A | L | L | L |
| 144B | H | L | L |
| 144C | L | H | L |
| 144D | H | H | L |
| 144E | L | L | H |
| 144F | H | L | H |
| 144G | L | H | H |
| 144H | H | H | H |

Here, the photoelectric sensors 331, 322, and 333 are respectively assigned to the first, second, and third digits, and the levels L or H of the output signals of the sensors 331, 322, and 333 are respectively represented "0" or "1". So, the aforementioned supporting or engagement state of the driven pins 144A to 144H are represented in the Table 2 below.

TABLE 2

| Driven Pin | Binary Number | Decimal Number |
|---|---|---|
| 144A | 000 | 0 |
| 144B | 001 | 1 |
| 144C | 010 | 2 |
| 144D | 011 | 3 |
| 144E | 100 | 4 |
| 144F | 101 | 5 |
| 144G | 110 | 6 |
| 144H | 111 | 7 |

In this way, the eight supporting or engagement state of the driven pins 144A to 144H can be discriminated by the combination of the output signals of the three sensors 331, 322, and 333. This means that the position of the frame 23 can be easily detected from the output signals of the sensors 331, 322, and 333.

Since the frame position sensor 33 having the aforementioned structure and function is provided, there is an additional advantage that position of the frame 23 during its vertical motion can be detected with a comparative simple structure.

Controller

Figure 26:
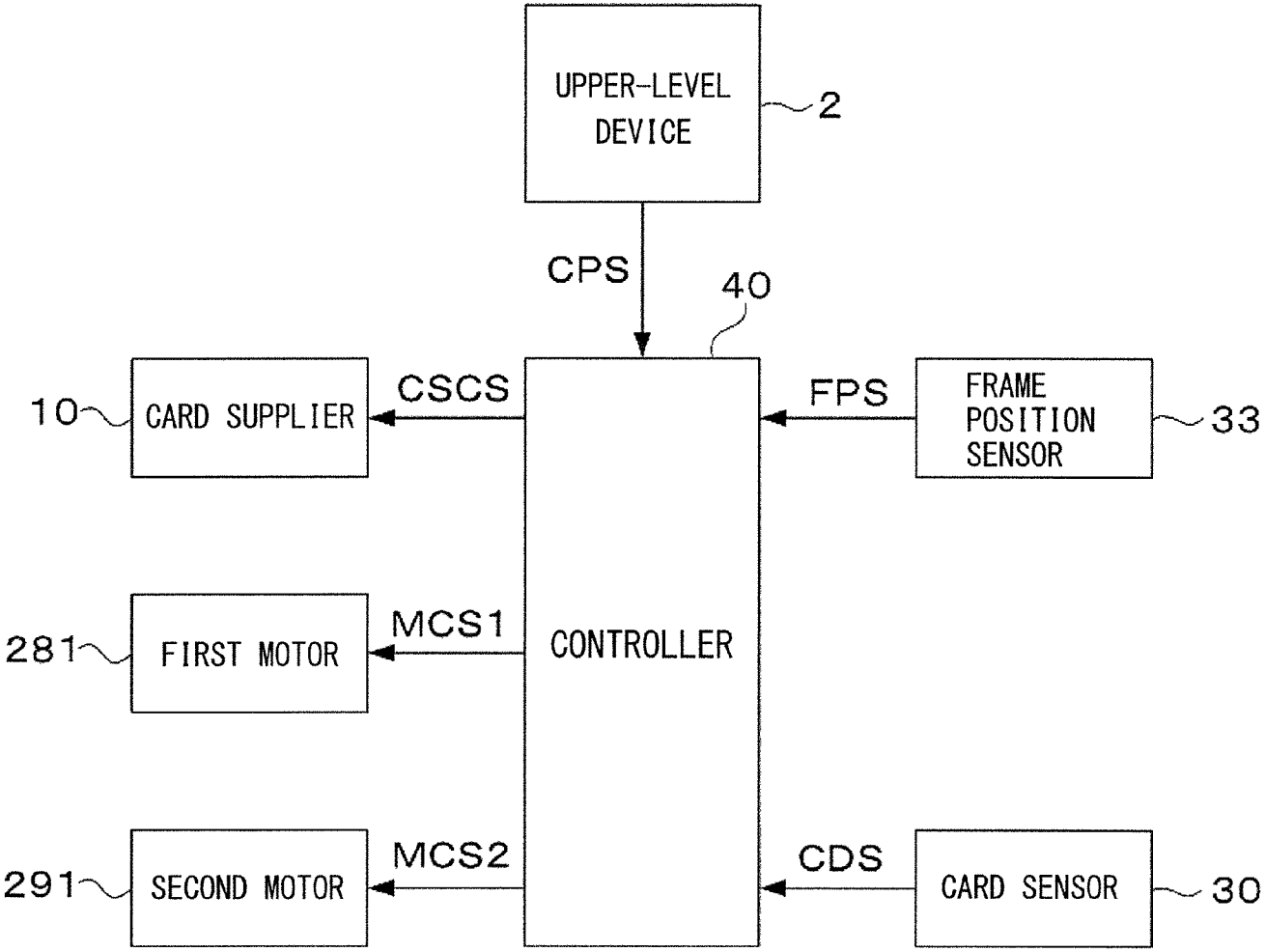
FIG. 26 is a functional block diagram showing the function of the controller of the card feeding apparatus of FIG. 1.

Next, the operation of the controller or control device 40 will be explained in detail with reference to FIG. 26.

The controller 40 controls the total operation of the card feeding apparatus 1 in the following wary.

The controller 40 sends (i) a card supply control signal CSCS to the card supplying device 10 to control its card supplying operation, (ii) sends a first motor control signal MCS1 to the first electric motor 281 to control the operation of the lifting mechanism 24, and (iii) sends a second motor control signal MCS2 to the second electric motor 291 to control the card conveying device 28. These control operations of the controller 40 are performed based on a card feeding signal CPS sent from an upper-level or host device 2 connected to the card feeding apparatus 1.

Moreover, the controller 40 receives a frame position signal FPS sent from the frame position sensor device 33 and card sensing signals CDS sent from the card sensor devices 30, thereby monitoring the current position of the frame 23 and the presence or absence of a card C on each of the tables 162A to 162H.

Operation of Card Feeding Apparatus

Figure 27:
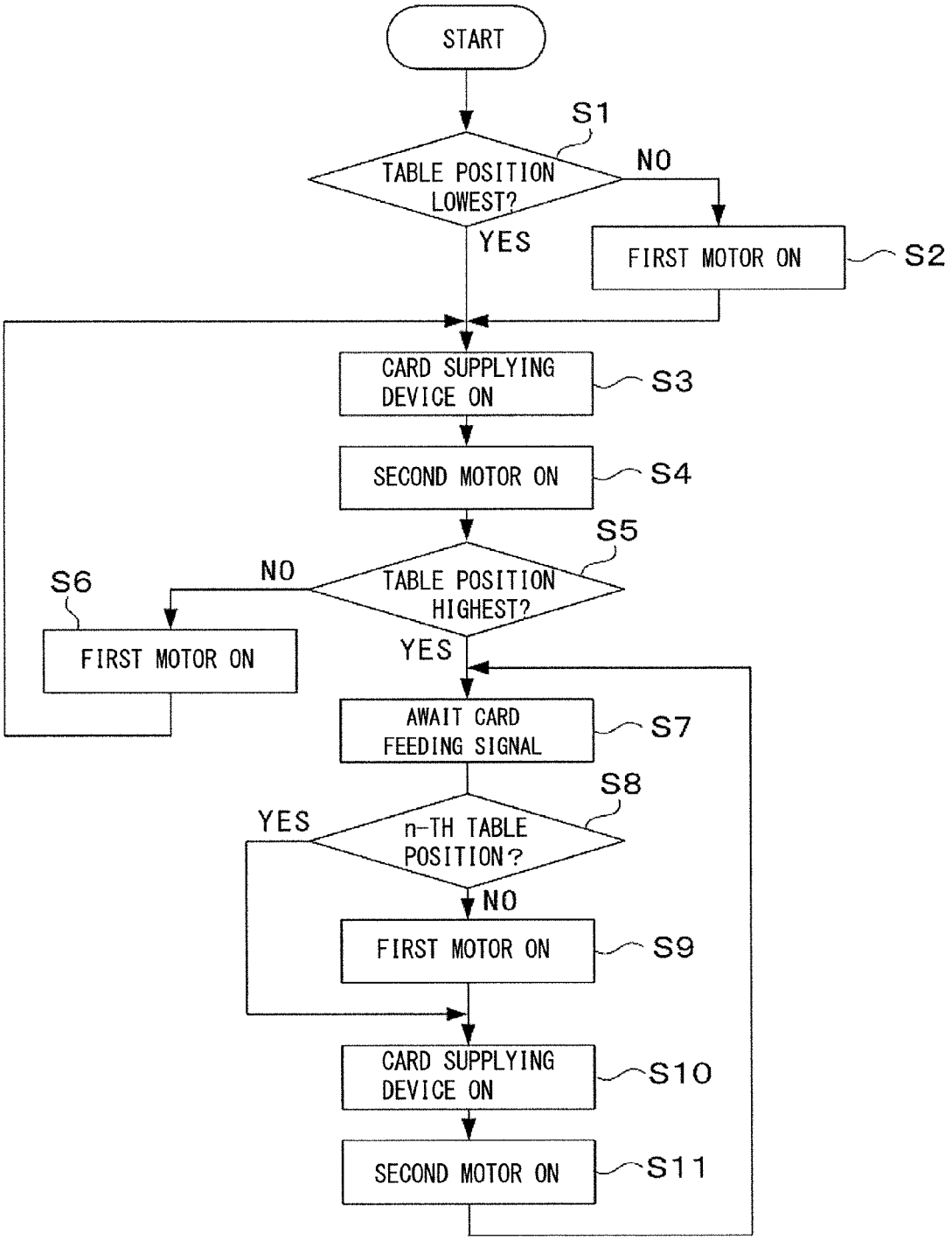
FIG. 27 is a flow chart explaining the operation of the card feeding apparatus of FIG. 1.

Next, the operation of the card feeding apparatus 1 according to the embodiment of the present invention will be explained in detail with reference to FIG. 27.

Prior to the start of the operation of the card feeding apparatus 1, cards C are vertically stacked in the storing space 11*a* of the card storing section 11 of the card supplying device 10.

First, the card placing process is carried out. In this process, cards C are successively supplied from the card stack which is formed in the card supplying device 10 to the card holding and feeding device 20, and successively placed on the respective tables 162A to 162H.

In the step S1, the controller 40 judges whether or not the lowest-positioned table 162A (i.e., the first table) is located at the predetermined card conveying position based on the frame position signal FPS which is sent from the frame position sensor device 33.

If the lowest-positioned table 162A is not located at the card conveying position, in other words, the judgement result in the step S1 is "NO", the operation flow goes to the next step S2, where the controller 40 sends the first motor control signal MCS1 to the first electric motor 281 to drive the lifting mechanism 24, thereby locating the table 162A at the card conveying position. Thereafter, the operation flow goes to the next step S3.

If the lowest-positioned table 162A (i.e., the first table) is located at the card conveying position, in other words, the judgement result in the step S1 is "YES", the operation flow goes to the step S3 directly.

In the step S3, the controller 40 sends the card supply control signal CSCS to the card supplying device 10 to operate the same, thereby supplying a first card C to the card conveying device 28 of the card holding and feeding device 20. In response to this, the first card C from the card supplying device 10 is moved and stopped at the card conveying position.

Subsequently, in the next step S4, the controller 40 sends the second motor control signal MCS2 to the second electric motor 291, thereby driving the card conveying device 28. At this time, the first card C supplied from the card supplying device 10 is located at the card conveying position and therefore, it can be conveyed forward by the card conveying device 28. Accordingly, the first card C is conveyed to the lowest-positioned table 162A by the first roller unit 25 of the card conveying device 28 and is placed on the table 162A.

In the subsequent step S5, a similar judgement to that in the step S1 is carried out for the highest-positioned table 162H (i.e., the eighth table). Specifically, the controller 40 judges whether or not the highest-positioned table 162H (i.e., the eighth table) is located at the predetermined card conveying position based on the frame position signal FPS which is sent from the frame position sensor device 33. At this time, the lowest-positioned table 162A (i.e., the first table) is located at the card conveying position and thus, the judgment in the step S5 is "NO" and then, the operation flow goes to the next step S6.

In the step S6, the controller 40 sends the first motor control signal MCS1 to the first electric motor 281 to drive the lifting mechanism 24, thereby locating the second lowest-positioned table 162B (i.e., the second table) to the card conveying position. Thereafter, the operation flow goes back to the step S3, where the controller 40 sends the card supply control signal CSCS to the card supplying device 10, thereby supplying a second card C to the card conveying mechanism 28 of the card holding and feeding device 20. In response to this, the second card C from the card supplying device 10 is moved and stopped at the card conveying position.

In the next step S4, the controller 40 sends the second motor control signal MCS2 to the second electric motor 291, thereby driving the card conveying mechanism 28. At this time, the second card C supplied from the card supplying device 10 is located at the card conveying position and therefore, it can be conveyed forward by the card conveying device 28. Accordingly, the second card C is conveyed to the second lowest-positioned table 162B by the first roller unit 25 of the card conveying device 28 and is placed on the table 162B.

Subsequently, the judgement in the step S5 is carried out again.

The aforementioned operations from the steps S3 to S6 are repeated for the remaining tables 162C to 162H (i.e., the third to eighth tables). As a result, third to eighth cards C are successively supplied to the card holding and feeding device 20 and placed on the respective tables 162C to 162H.

Finally, the first to eighth cards C are placed on the tables 162A to 162H (i.e., the first to eighth tables), respectively. At this time, the highest-positioned table 162H (i.e., the eighth table) is located at the card conveying position and therefore, the judgment result in the step S5 is turned "YES". Then, the operation flow goes to the next step S7.

From here, the card feeding process is carried out. In this process, the first to eighth cards C placed on the respective tables 162A to 162H (i.e., the first to eighth tables) are selectively and randomly fed to the outside of the card feeding apparatus 1 according to the necessity.

In addition, in this embodiment, as explained below, an additional card C is quickly supplied to the designated one of the tables 162A to 162H immediately after the existing card C on the designated table is fed forward, which is realized by way of a single conveying card process, there is an additional advantage that the card feeding apparatus 1 operates more efficiently.

In the step S7, the controller 40 awaits the reception of the card feeding signal CPS sent from the upper-level device 2. The card feeding signal CPS is a command that designates a n-th table (n is an integer selected from 1 to 8) from the tables 162A to 162H (i.e., the first to eighth tables) and that instructs the feeding operation of a card C from the n-th table thus designated. When receiving the card feeding signal CPS including the aforementioned command in the step S7, the operation flow goes to the next step S8.

In the step S8, the controller 40 judges whether or not the n-th table designated by the said command is located at the card conveying position. If the judgement result in the step S8 is "NO", the operation flow goes to the next step S9. In this step, the controller 40 sends the first motor control signal MCS1 to the first motor 281 to drive the lifting mechanism 24, thereby locating the n-th table designated by the card feeding signal CPS at the card conveying position. Thereafter, the operation flow goes to the next step S10.

If the judgement result in the step S8 is "YES", the n-th table designated by the said command is located at the card conveying position and thus, the operation flow goes directly to the next step S10.

In the step S10, the controller 40 sends the card supply control signal CSCS to the card supplying device 10 to operate the same, thereby supplying an additional card C to the card conveying device 28 of the card holding and feeding device 20. In response to this, the additional card C from the card supplying device 10 is moved and stopped at the card conveying position.

Subsequently, in the next step S11, the controller 40 sends the second motor control signal MCS2 to the second electric motor 291, thereby driving the card conveying device 28. At this time, the additional card C supplied from the card supplying device 10 is located at the card conveying position and therefore, it can be conveyed forward by the card conveying device 28. Moreover, at this time, the card C held on the n-th table (i.e., the table designated from the eight tables 162A to 162H) is located at the card conveying position, which means that the card C on the n-th table is in the state where it can be conveyed forward by the card conveying device 28.

Accordingly, the card C held on the n-th table (i.e., the table designated from the eight tables 162A to 162H) is fed forward in the card feeding direction CD by the operations of the second and third roller units 26 and 27 of the card conveying device 28. Immediately after that, the additional card C which has been supplied from the card supplying device 10 and which is located at the card conveying position is conveyed forward and placed on the n-th table by the operation of the first roller unit 25 of the card conveying device 28.

After completing the aforementioned card feeding process for the n-th card, the operation flow goes back to the step S7 and the steps S7 to S11 are repeated again. These steps S7 to S13 are repeated as necessary in response to the card feeding signal CPS sent from the upper-level device 2.

In this way, a card C held on any one of the tables 162A to 162H (i.e., the first to eight tables) which is designated by the card feeding signal CPS can be selectively and randomly fed in the card feeding direction CD in accordance with the card feeding signal CPS from the upper-level device 2.

As seen from the aforementioned detailed explanation, the card feeding apparatus 1 according the embodiment of the present invention comprises the card supplying device 10 including the card storing section 11 for vertically storing cards C so as to form a card stack, and the card conveying section 12 for conveying a desired card C from the card stack one by one to the supply port 13, the card holding and feeding device 20 for holding cards C supplied from the card supplying device 10 through the supply port 13 thereof, and for feeding the cards C toward outside the apparatus 1 in the predetermined card feeding direction CD one by one; and the controller 40 for controlling the operation of the card supplying device 10 and the operation of the card holding and feeding device 20.

In the card holding and feeding device 20, the table set 22 includes the tables 162A to 162H which are stacked vertically at the predetermined pitch H1 in such a way that cards C supplied from the card supplying device 10 through the supply port 13 are placed on the respective tables 162A to 162H. The frame 23 supports the table set 22 so as to enclose all the tables 162A to 162H. The lifting mechanism 24 moves vertically the frame 23. The card conveying device 28 conveys cards C which are held on the respective tables 162A to 162H of the table set 22 to the outside of the apparatus 1 in the predetermined card feeding direction CD one by one.

Under control of the controller 40, the frame 23 is temporarily stopped at the predetermined card conveying position corresponding to the supply port 13 of the card supplying device 10 while vertically moving the frame 23 by the lifting mechanism 24, and the card supplying device 10 and the card holding and feeding device 20 are activated, thereby placing cards C which are supplied from the card supplying device 10 on the respective tables 162A to 162H of the table set 22.

Therefore, if cards C of different types/kinds are stored so as to form a card stack in the card storing section 11 of the card supplying device 10 in advance, the cards C of the different types/kinds can be placed and held on the respective tables 162A to 162H of the table set 22.

Moreover, under control of the controller 40, in response to the card feeding signal CPS sent from the upper-level device 2 of the card feeding apparatus 1, the frame 23 is temporarily stopped in such a way that a target table which is designated by the card feeding signal CPS from the tables 162A to 162H of the table set 22 is located at the predetermined card conveying position, and the card conveying device 28 is activated, thereby feeding a card C held on the target table in the card feeding direction CD.

Therefore, the cards C of the different types/kinds which have been placed and held on the respective tables 162A to 162H of the table set 22 can be selectively and randomly fed in the card feeding direction CD toward the outside of the apparatus 1 according to the necessity.

Accordingly, random and selective feeding of cards in a predetermined direction can be ensured even if the cards are of different types or kinds.

In addition, unlike the aforementioned first prior-art card feeding apparatus disclosed in the Japanese Patent No. 4991995, a plurality of card supplying devices and a plurality of card holding and feeding devices need not be provided for each type/kind of cards. Thus, the overall size of the card feeding apparatus 1 is not excessively enlarged.

Further in addition, unlike the aforementioned second prior-art card issuing apparatus disclosed in the Japanese Non-Examined Patent Publication No. 5-210783, the cards C which have been held on the respective tables 162A to 162H of the table set 22 can be selectively and randomly fed one by one in the card feeding direction CD in response to the card feeding signal CPS. Thus, by determining appropriately the size of the card storing section 11 of the card supplying device 10, the limitation on the total number of the cards C to be fed can be eliminated.

Accordingly, random and selective feeding of cards of different types or kinds in a predetermined direction can be ensured while restraining excessive increase of the overall size of the apparatus 1 and ensuring a desired total number of the cards to be fed.

In this embodiment, all the tables 162A to 162H in the table set 22 are vertically arranged at the fixed pitch H1 and are independently movable forward and backward in the frame 23, and the aforementioned sliding mechanism is provided for the table set 22. When any one of the tables 162A to 162H in the table set 22 is designated as the target table, the target table is moved backward to the card conveying position in response to the card feeding signal CPS using the sliding mechanism in synchronization with a vertical motion of the frame 23 to a designated position by lifting mechanism 24. Thus, there is an additional advantage that the target table can be surely moved to the card conveying position by simply moving the frame 23 vertically to the designated position in response to the card feeding signal CPS.

In addition, when all the tables 162A to 162H in the table set 22 are defined as first to n-th tables, where n is an integer greater than unity, the controller 40 performs the card placing process and the card feeding process. In the card placing process, cards C are successively supplied from the card supplying device 10 to the card conveying position and are successively placed on the first to n-th tables. In the card feeding process, the card C placed on the target table which is designated from the first to n-th tables is conveyed forward in response to the card feeding signal CPS.

For this reason, initially, cards C are successively placed on the first to n-th tables in the table set 22 in the card placing process and thereafter, the card C placed on the target table is selectively conveyed forward in response to the card feeding signal CPS in the card feeding process. Thus, there is an additional advantage that cards C can be surely placed on all the first to n-th tables in the table set 22 before starting the card feeding process.

Further in addition, a placing motion of an additional card C which is supplied from the card supplying device 10 on the target table is performed in synchronization with a conveying motion of the card C held on the target table. Therefore, there is an additional advantage that the placing motion of the additional card C on the target table can be started immediately after completing the conveying motion of the card C placed on the target table, and that this can be obtained easily by commonly using the card conveying device 28 for the placing motion of the additional card C on the target table and the conveying motion of the card C on the target table. These additional advantages raise the operation speed or efficiency of the card feeding apparatus 1 and simplify the structure of the card conveying device 28.

Variations

The aforementioned embodiment is an embodied example of the present invention. Thus, it is needless to say that the present invention is not limited to the above-described embodiment and any other modification is applicable to the embodiment.

For example, in the aforementioned card feeding apparatus 1, the lifting mechanism 24 (i.e., the table set moving device) is formed using the driven pins 144A to 144H and the lifting gears 202R and 202H; however, the present invention is not limited to this. For example, the lifting mechanism 24 (i.e., the table set moving device) may be formed by using rack gears and pinion gears.

In addition, to slidably support the tables 162A to 162H in the frame 23, the table supporting members 138A to 138I are formed on the right and left side plates 136R and 136L of the frame 23 in the aforementioned card feeding apparatus 1; however, the table supporting members 138A to 138I may be omitted. The is because the tables 162A to 162H can be slidably supported by the frame 23 using the engagement between the guide pins 172 and 174 of the tables 162A to 162H and the guide holes 142R and 142L of the frame 23.

The photoelectric sensors 331, 332, and 333 of the card sensor device 30 are of the transmission type in the aforementioned card feeding apparatus 1; however, they may be of the reflection type. In this case, the card holding state of the tables 162A to 162H may be directly detected using reflection-type photoelectric sensors.

The frame 23 is used as the table set supporting structure in the aforementioned embodiment; however, the frame 23 may be replaced with any other structure if it supports the table set 22 so as to enclose all the tables 162A to 162H.

The lifting mechanism 24 is used as the table set moving device in the aforementioned embodiment; however, the lifting mechanism 24 may be replaced with any other mechanism or device if it moves vertically the table set supporting structure such as the frame 23.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A card feeding apparatus for random and selective feeding of cards of different types or kinds which are held therein, comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction;

and wherein a pair of vertically extending sidewalls is formed respectively at both sides of the table set supporting structure with respect to the card feeding direction in such a way that the table set supporting structure is moved vertically in a space between the pair of sidewalls by the table set moving device.

2. The card feeding apparatus according to claim 1, wherein in response to the card feeding signal, a placing motion of an additional card which is supplied from the card supplying device on the target table is interlocked with a conveying motion of the card held on the target table.

3. The card feeding apparatus according to claim 1, wherein the card conveying device comprises a first roller unit for conveying forward a card which is moved to the card conveying position from the card supplying device;

a second roller unit for conveying forward the card which is conveyed on the target table by the first roller unit; and a third roller unit for conveying forward the card which is conveyed forward from the target table by the second roller unit.

4. The card feeding apparatus according to claim 1, wherein when all the tables in the table set are defined as first to n-th tables, where n is an integer greater than unity, the controller performs a card placing process and a card feeding process;

and wherein in the card placing process, cards are successively supplied from the card supplying device to the card conveying position and are successively placed on the first to n-th tables;

and wherein in the card feeding process, the card placed on the target table which is designated from the first to n-th tables is conveyed forward in response to the card feeding signal.

5. The card feeding apparatus according to claim 4, wherein a placing motion of an additional card which is supplied from the card supplying device on the target table is performed in synchronization with a conveying motion of the card held on the target table.

6. A card feeding apparatus comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction; and a sliding mechanism for selectively sliding a specified one of the tables of the table set to the card conveying position so as to be interlocked with a vertical motion of the table set without sliding the remaining tables.

7. The card feeding apparatus according to claim 6, further comprising a pair of sidewalls arranged respectively at both sides of the table set with respect to the card feeding direction;

wherein each of the pair of sidewalls comprises a cam hole having a first linear part, a second linear part, and a bended part formed between the first and second linear parts;

and wherein each of the tables in the table set has right and left cam followers which are respectively engaged with the cam holes of the pair of sidewalls;

and wherein the cam holes of the pair of sidewalls and the cam followers of the tables constitute the sliding mechanism.

8. A card feeding apparatus comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction; and wherein the card conveying device comprises a pair of rollers which is contactable with a card held on the target table;

and wherein when feeding the card held on the target table, the pair of rotating rollers is contacted with the card on the target table at its two side edges, thereby conveying the card on the target table in the card feeding direction;

and wherein the cards held on all the tables in the table set are kept detached from the pair of rotating rollers while the table set is moved vertically.

9. A card feeding apparatus comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction; wherein each of the tables in the table set comprises a lever which is moved between a standby position and a protruded position in response to a placing motion of a card;

and wherein presence and absence of a card on each of the tables is judged by detecting which one of the standby position and the protruded position the lever is located at.

10. A card feeding apparatus comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction;

wherein the table set moving device comprises driven pins respectively formed on a pair of side plates of the table set supporting structure, and a pair of gears which are rotatably supported and which are respectively engaged with the driven pins on the pair of side plates;

and wherein the table set supporting structure is moved vertically by forward and backward rotation of the pair of gears.

11. A card feeding apparatus, comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction, further comprising operating protrusions arranged on respective arrangement lines extending vertically on a side plate of the table set supporting structure, and sensors provided on the respective arrangement lines for sensing the corresponding operating protrusions;

wherein the position of the table set supporting structure during its vertical motion is detected based on combination of output signals of the sensors.

12. A card feeding apparatus comprising:

a card supplying device including a card storing section for vertically storing cards so as to form a card stack, and a card conveying section for conveying a desired card from the card stack one by one to a supply port;

a card holding and feeding device for holding cards supplied from the card supplying device through the supply port thereof, and for feeding the cards toward an outside of the apparatus in a predetermined card feeding direction one by one; and a controller for controlling operations of the card supplying device and the card holding and feeding device;

wherein the card holding and feeding device comprises;

a table set including tables which are stacked vertically at a predetermined pitch in such a way that cards supplied from the card supplying device through the supply port thereof are placed on the respective tables;

a table set supporting structure that supports the table set so as to enclose all the tables;

a table set moving device that moves vertically the table set supporting structure; and a card conveying device that conveys cards which are held on the respective tables of the table set toward the outside of the apparatus in the card feeding direction one by one;

and wherein under control of the controller, the table set supporting structure is temporarily stopped at a predetermined card conveying position corresponding to the supply port of the card supplying device while vertically moving the table set supporting structure by the table set moving device, and the card supplying device and the card holding and feeding device are activated, thereby placing cards which are supplied from the card supplying device on the respective tables of the table set;

and wherein under control of the controller, in response to a card feeding signal sent from an upper-level device of the apparatus, the table set supporting structure is temporarily stopped in such a way that a target table which is designated by the card feeding signal from the tables of the table set is located at the card conveying position, and the card conveying device is activated, thereby conveying the card held on the target table toward the outside of the apparatus in the card feeding direction; wherein all the tables in the table set are vertically arranged at a fixed pitch and are independently movable forward and backward in the table set supporting structure, and a sliding mechanism is provided for the table set;

and wherein when any one of the tables in the table set is designated as the target table, the target table is moved backward to the card conveying position in response to the card feeding signal using the sliding mechanism in synchronization with a vertical motion of the table set supporting structure to a designated position by the table set moving device.

* * * * *